United States Patent [19]

Hartmann et al.

[11] Patent Number: 4,616,662

[45] Date of Patent: Oct. 14, 1986

[54] METHOD AND APPARATUS FOR PRODUCING A ROD-SHAPED FILLER FROM SEVERAL TYPES OF SMOKABLE MATERIAL

[75] Inventors: Werner Hartmann, Hamburg; Gottfried Hoffmann, Schwarzenbek; Joachim Reuland, Neu Börnsen, all of Fed. Rep. of Germany

[73] Assignee: Hauni-Werke Körber & Co. KG., Hamburg, Fed. Rep. of Germany

[21] Appl. No.: 622,680

[22] Filed: Jun. 20, 1984

[30] Foreign Application Priority Data

Jun. 29, 1983 [DE] Fed. Rep. of Germany ..... 3323357
Oct. 6, 1983 [DE] Fed. Rep. of Germany ..... 3336293

[51] Int. Cl.[4] ..... A24C 5/18

[52] U.S. Cl. ..... 131/84.1; 131/84.3; 131/904; 131/905; 131/906

[58] Field of Search ..... 131/84.1, 84.3, 904, 131/905, 906

[56] References Cited

U.S. PATENT DOCUMENTS 4,516,585 5/1985 Pinkham ..... 131/84.3

*Primary Examiner*—V. Millin
*Attorney, Agent, or Firm*—Peter K. Kontler

[57] ABSTRACT

A continuous rod-like filler is formed in a cigarette rod making machine on an endless foraminous belt conveyor by depositing a row of spaced-apart batches consisting of a first type of tobacco at one side of the conveyor, holding the batches by suction, and showering tobacco particles of a second type onto and/or into the spaces between the batches. The density of successive increments of the filler is monitored by a pneumatic and/or radiation type detector, and the thus obtained density signals are used to generate control signals which regulate the density of the filler as well as control signals which are used to influence the batches, if and when necessary. For this purpose, the density signals can be processed to single out those which are attributable to monitoring of the density of successive batches, and the singled out density signals are then analyzed and used to vary one or more parameters of the batches.

40 Claims, 11 Drawing Figures

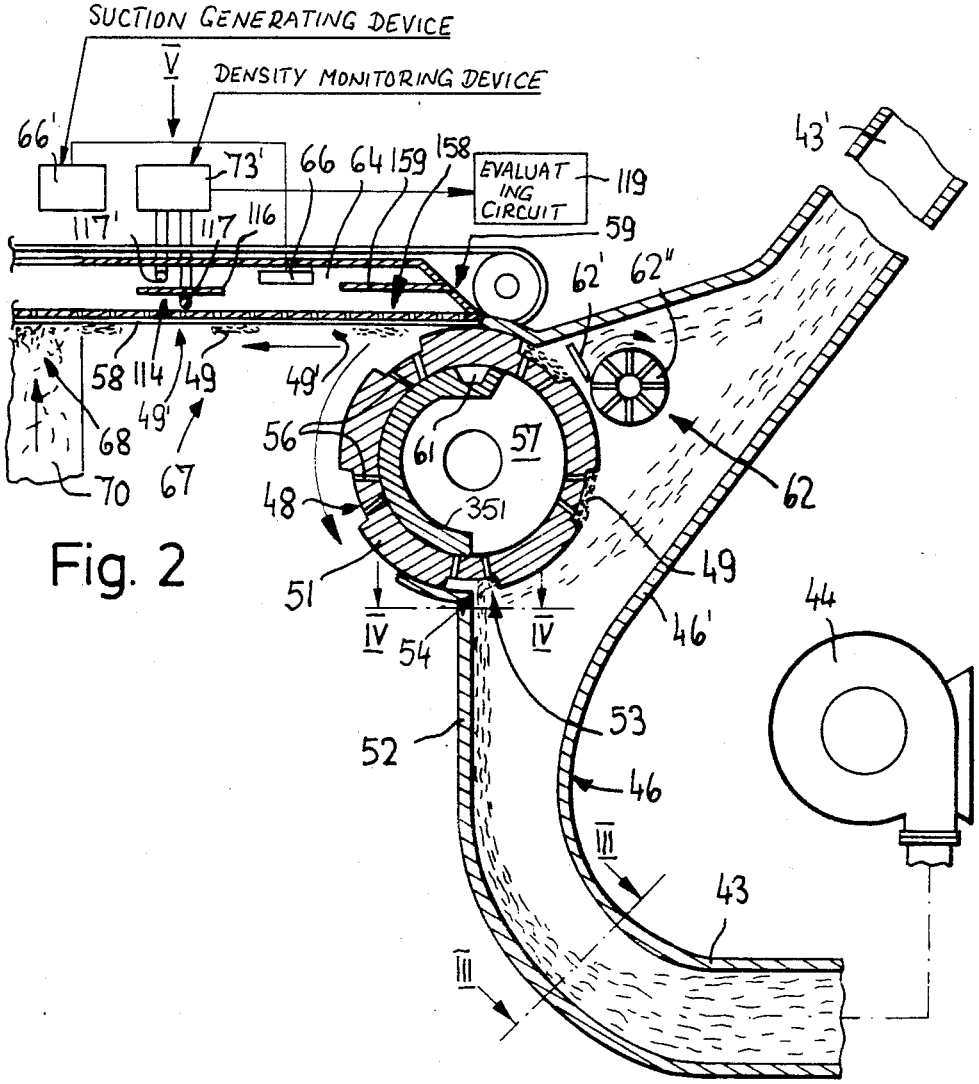
Fig. 2
Fig. 5
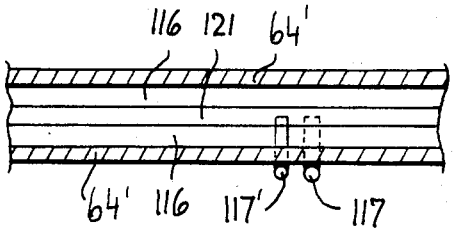
Fig. 4
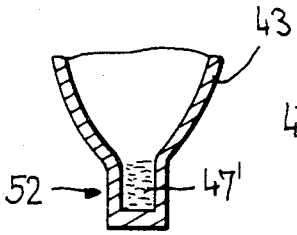
Fig. 3
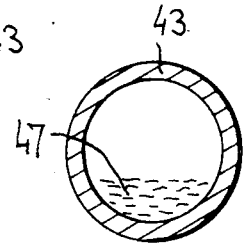

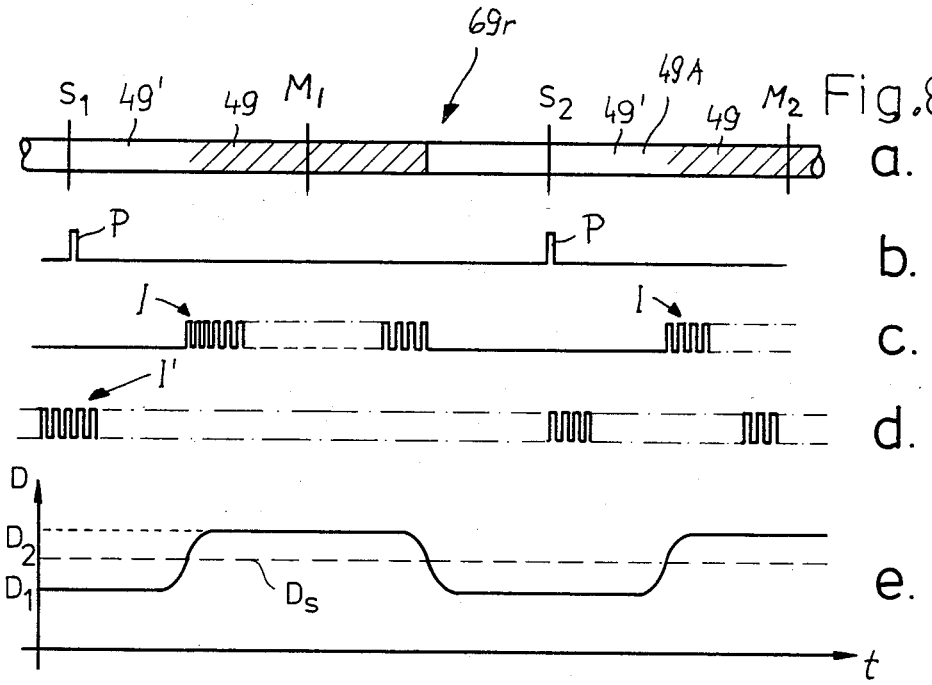
Fig. 8
Fig. 9
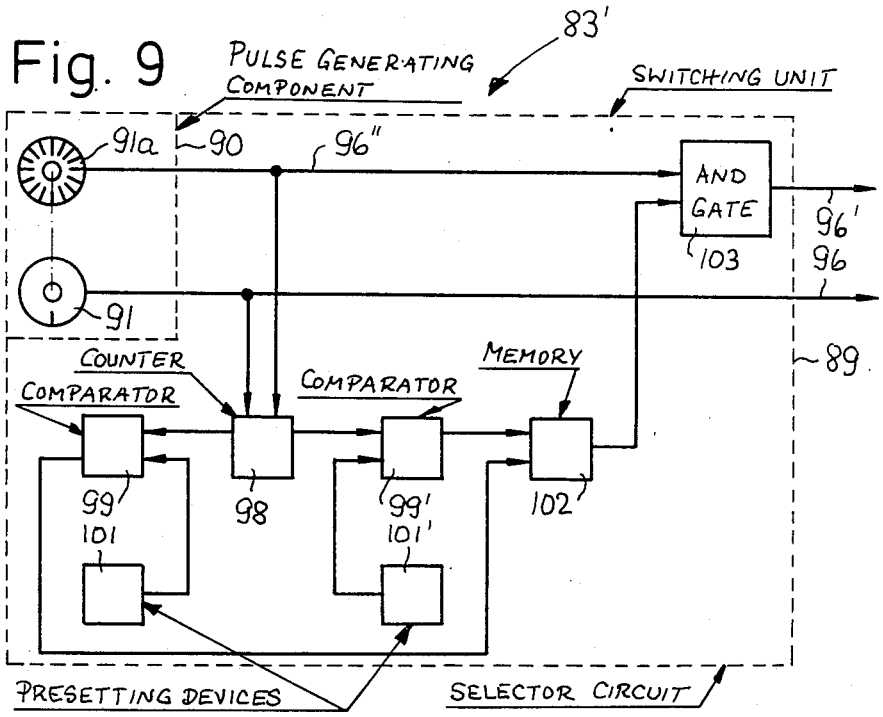

METHOD AND APPARATUS FOR PRODUCING A ROD-SHAPED FILLER FROM SEVERAL TYPES OF SMOKABLE MATERIAL

CROSS-REFERENCE TO RELATED CASE

Apparatus which can be used to make composite fillers in cigarette making or like machines are disclosed in commonly owned patent application Ser. No. 557,733 filed Dec. 2, 1983 by Gunter Wahle et al.

BACKGROUND OF THE INVENTION

The present invention relates to machines for the making of cigarettes, cigars, cigarillos or other rod-shaped smokers' articles which contain substitute, reconstituted and/or natural tobacco. More particularly, the invention relates to a method and apparatus for making composite fillers for assembly with cigarette paper or other suitable wrapping material into continuous rods which are thereupon subdivided into rod-shaped articles of desired length. Still more particularly, the invention relates to improvements in a method and an apparatus for making tobacco fillers (this term is intended to embrace fillers containing substitute, reconstituted and/or natural tobacco) which contain several types of tobacco.

It is already known to make tobacco fillers from two different types of tobacco in such a way that filler portions containing a first type of tobacco alternate with filler portions which contain a second type of tobacco, as considered in the longitudinal direction of the rod-like filler. For example, German Offenlegungsschrift No. 24 45 856 discloses a method and an apparatus for making a rod-like filler by forming a series of spaced-apart batches from a first type of tobacco in the peripheral recesses of a suction wheel, by depositing such batches in the form of a row on an air-permeable belt conveyor, and by showering tobacco particles of a second type into the spaces between the batches. The filler is thereupon trimmed to remove the surplus of tobacco and the thus obtained finished filler is draped into a web of cigarette paper. The lengths of batches of tobacco of the first type and the lengths of the spaces between such batches are selected in such a way that, when the cigarette rod (wrapped filler) is subdivided into rod-shaped articles (e.g., plain cigarettes) of unit length, each discrete article contains tobacco of the first type as well as tobacco of the second type.

A drawback of heretofore known methods and apparatus for the making of composite fillers is that the making of such fillers cannot be regulated with a required degree of accuracy. Thus, it can happen that the batches which contain the first type of tobacco are too close to each other or too far apart. Furthermore, it can happen that the trimming operation results in removal of excessive quantities of tobacco particles of the first or second type. Still further, it is not possible to properly monitor the ratio of tobacco particles of the first type to tobacco particles of the second type and/or to undertake corrective steps if the ratio is unsatisfactory except by arresting the machine with attendant huge losses in output.

The reasons for using several types of tobacco for the making of a tobacco filler are numerous. For example, it may be desirable to produce plain cigarettes wherein tobacco particles with lower nicotine content are closer to the end which is inserted into the smoker's mouth. Also, a maker of cigarettes may wish to use substitute tobacco in a certain portion of the tobacco-containing part of a filter cigarette, cigar or cigarillo. Still further, it may be desirable to introduce lower-grade tobacco into selected portions of the filler so as to occupy certain portions of tobacco fillers in finished plain of filter cigarettes, cigars or cigarillos.

OBJECTS AND SUMMARY OF THE INVENTION

An object of the invention is to provide a novel and improved method of making composite fillers for cigarette rods or the like in such a way that the composition of the filler can be reliably and accurately ascertained during practically any desired stage of the making of cigarettes, cigars or cigarillos which contain portions of such fillers.

Another object of the invention is to provide a method which renders it possible to influence the characteristics and/or other parameters of filler portions which contain different types of tobacco in a cigarette rod or the like.

A further object of the invention is to provide a method which renders it possible to practically immediately influence the composition of the filler as soon as it begins to deviate from the optimum value.

An additional object of the invention is to provide a method which renders it possible to rapidly, predictably and accurately vary one or more parameters of filler portions which contain certain types of tobacco.

Still another object of the invention is to provide a method which renders it possible to avoid intermixing of tobacco particles of different types.

A further object of the invention is to provide a method which can be resorted to in connection with the making of composite fillers having alternating filler portions consisting of different tobacco types with a heretofore unmatched degree of regularity.

Another object of the invention is to provide a novel and improved apparatus for the practice of the above outlined method.

An additional object of the invention is to provide a tobacco rod making machine which embodies the above outlined apparatus.

A further object of the invention is to provide an apparatus which can be used to ascertain, evaluate and alter one or more characteristics of a continuous composite tobacco filler in such a way that each and every ultimate product, such as a plain cigarette, contains accurately determined quantities of different types of tobacco in accurately determined portions of the article.

An additional object of the invention is to provide the apparatus with novel and improved means for monitoring the filler and with novel and improved means for evaluating the results of the monitoring operation.

A further object of the invention is to provide an apparatus which constitutes an improvement over and a further development of the apparatus which is disclosed in the aforementioned Offenlegungsschrift.

Another object of the invention is to provide the apparatus with novel and improved means for indicating the development of pileups of tobacco particles in one or more filler forming zones.

An additional object of the invention is to provide the apparatus with novel and improved means for displaying the results of the monitoring operation, with novel and improved means for automatically indicating the ratio of defective filler sections to satisfactory filler sections and/or the extent to which certain characteristics of various sections of a continuous filler deviate from optimum characteristics.

Another object of the invention is to provide the apparatus with novel and improved means for processing signals which are indicative of the density of successive increments of a composite tobacco filler which is about to be converted into a cigarette, cigar or cigarillo rod.

A further object of the invention is to provide an apparatus which can automatically segregate unsatisfactory portions of a composite filler from satisfactory portions.

One feature of the invention resides in the provision of a method of producing a continuous rod-like filler of fibrous material, especially a tobacco filler. The method comprises the steps of accumulating fibrous material of a first type into a row of spaced apart batches or plugs and conveying the row of batches along a predetermined path, delivering (e.g., showering) fibrous material of a second type onto and/or into the spaces between the batches of the row so that the two types of fibrous material together form a rod-like filler, generating first signals which are indicative of at least one parameter of the batches in the path, converting the first signals into first control signals, and utilizing the first control signals to influence at least one parameter of the batches. The method preferably further comprises the steps of monitoring at least one parameter of the filler and generating second signals which are indicative of such parameter of the filler, converting the second signals into second control signals, and utilizing the second control signals to influence at least one parameter of the filler. Thus, the making of the filler can be influenced simultaneously with the influencing of the batches, e.g., the rate at which the excess of fibrous material is being removed from the filler can be regulated simultaneously with a regulation of densification of fibrous material of the first type to form the batches.

In accordance with a presently preferred embodiment of the method, the step of monitoring at least one parameter of the filler includes continuously monitoring the density of the filler, and the step of generating first signals can include processing those portions of the second signals which are generated during monitoring of the batch-containing portions of the filler (i.e., which are indicative of the density of the batches). The converting steps preferably include evaluating the first and second signals independently of one another, e.g., in two discrete branches or units of an evaluating circuit.

The step of utilizing the first control signals preferably includes influencing the density of the batches and the step of utilizing the second control signals can include influencing the density of the filler, e.g., by removing a larger or a smaller quantity of surplus or excess from the filler prior to draping of the filler into a web of cigarette paper or the like and prior to monitoring of the wrapped filler by a density measuring device.

The draping takes place subsequent to removal of excess from the filler and is followed by the step of cyclically subdividing the wrapped and equalized filler into articles of finite length (e.g., into plain cigarettes of double unit length) at a predetermined frequency so that each article contains at least one batch and at least one portion of fibrous material of the second type. The step of generating first signals can include generating a sequence of incremental timing pulses, at least during that portion of each cycle when the generation of second signals involves monitoring a batch-containing portion of the filler, and utilizing the incremental timing pulses for selective conversion of simultaneously generated second signals into the first control signals. For example, if the second signals denote the density of the respective portions of the filler, the step of generating first signals can include separately processing those density signals which are generated during the monitoring of batches in the filler.

As a rule, the delivering step includes admitting (e.g., by way of a duct) into the path fibrous material of the second type at a rate which exceeds the required quantity of such material in the filler. The method then further comprises the step of removing the excess from the filler in the path, and the step of utilizing the second control signals can include regulating the rate of removal of excess from the filler. This directly influences the density of the filler downstream of the location of monitoring because the removal of excess takes place prior to draping of the trimmed or equalized filler into a web of wrapping material. Since the diameter of the draped filler is the same at all times, the rate at which the excess is being removed determines the density of the draped filler, and such density is thereupon monitored for the purpose of generating second signals. As mentioned above, the step of utilizing the first control signals can include influencing the density of the batches.

The monitoring step can include passing radiation across the path of the filler and monitoring the intensity of radiation which penetrates through successive increments of the filler because such intensity is indicative of the density of the respective increments of the filler.

The conveying step can include transporting the batches on a foraminous conveyor (e.g., at the underside of the lower flight of an endless belt conveyor), and the monitoring step can include ascertaining the combined permeability of the conveyor and the fibrous material thereon in a predetermined portion of the path. The arrangement can be such that the generation of first signals involves monitoring the permeability of the conveyor and of the fibrous material thereon, and the generation of second signals involves monitoring the density of successive increments of the trimmed and draped filler with a monitoring device which directs corpuscular radiation across the path of the filler. The first control signals can be used to influence the formation of batches, and the second control signals can be used to influence a parameter (particularly density) of the filler (e.g., in the aforedescribed manner by regulating the rate of removal of excess fibrous material from the filler downstream of the location of delivery of fibrous material of second type into the path). Fibrous material of the first type can constitute natural tobacco shreds and fibrous material of the second type can constitute shreds of reconstituted or substitute tobacco, or vice versa.

The accumulating step can include delivering fibrous material of the first type into an endless second path (e.g., against the periphery of a rotating suction wheel) and attracting the thus delivered fibrous material of the first type by suction to selected portions of the second path (e.g., in pockets which are machined into or otherwise formed in the periphery of the suction wheel). The step of utilizing the first control signals can include regulating the suction in the selected portions of the second path.

The method can further comprise the steps of monitoring the dimensions and positions of the batches in the path relative to one another and segregating from the series of articles which are obtained by cyclically severing the wrapped filler those articles which contain improperly dimensioned and/or positioned batches. The step of monitoring the dimensions and/or positions of batches in the path can include timing the start and termination of generation of those second signals which are indicative of the density of batches.

Still further, the method can include evaluating the first signals including classifying the first signals according to integrity or lack of integrity of the respective batches. Such method can further comprise the step of separately counting signals which are indicative of satisfactory and unsatisfactory batches.

Another feature of the invention resides in the provision of a machine for the making of rod-shaped articles, and more particularly in the provision in such a machine of an apparatus for producing a continuous rod-like filler of fibrous material, particularly a tobacco filler. The apparatus comprises means (e.g., a suction wheel) for accumulating fibrous material of a first type into a row of spaced apart batches or plugs, means (e.g., a foraminous belt conveyor and a suction chamber) for conveying the row of batches in a predetermined direction and along a predetermined path, means (e.g., a duct) for delivering fibrous material of a second type onto and/or into the spaces between the batches in the path so that the two types of fibrous material together form a rod-like filler, means (e.g., including a differential pressure type density monitoring device) for generating first signals which are indicative (directly or indirectly) of at least one parameter of the batches in the path (e.g., such first signals can be indicative of the density of batches), a first unit (which can constitute a part of an evaluating circuit) for converting the first signals into first control signals, and means for influencing at least one parameter of the batches as a function of the intensity and/or another characteristic of the first control signals. Such influencing means can include means for influencing the density of the batches.

The signal generating means preferably comprises means for monitoring at least one parameter of the filler in the path (such monitoring means can include a source of corpuscular radiation and a transducer (such as an ionization chamber) which ascertains the intensity of radiation that penetrates through successive increments of the filler and is indicative of the density of the respective increments) and for generating second signals which are indicative of such parameter or parameters of the filler, a second unit for converting the second signals into second control signals (such second unit can form part of the aforementioned evaluating circuit), and means for influencing at least one parameter of the filler in the path as a function of the intensity and/or another characteristic of the second control signals (such influencing means can include means for adjusting the device which removes the excess of fibrous material from the filler before the latter is draped into a web of cigarette paper or the like).

The apparatus can further comprise a switching unit which forms part of the evaluating circuit and is connected with the monitoring means as well as with the first unit and includes means for effecting selective transmission to the first unit of those second signals which are generated during monitoring of the batch-containing portions of the filler so that such selectively transmitted second signals then constitute the first signals.

At least one of the accumulating and delivering means normally includes means for supplying fibrous material in excess of that which is required in the filler, and such apparatus further comprises adjustable trimming means which removes the excess from the filler. The means for influencing at least one parameter of the filler can include means for adjusting the trimming means to thereby vary the density of the filler by varying the quantity of fibrous material per unit length of the filler. The monitoring means preferably includes means for measuring the density of the filler, e.g., with corpuscular radiation as already mentioned above. The accumulating means is or can be adjustable, and the means for influencing at least one parameter of the batches can include means (e.g., a valve in a suction pipe connecting a suction generating device with a suction chamber of the accumulating means) for adjusting the accumulating means. For example, the accumulating means can comprise a conveyor (such as a rotary suction wheel) having recesses or otherwise configurated batch-receiving portions, means (e.g., a suitably configurated conduit) for supplying fibrous material of the first type to the batch-receiving portions of the conveyor, and adjustable means (such as the aforementioned suction chamber and the means for connecting the suction chamber with the suction generating device) for attracting fibrous material of the first type to the batch-receiving portions of the conveyor with a variable force which influences the density of the batches. The adjusting means then comprises means for adjusting the attracting means.

The apparatus further comprises means for draping the filler into a web of wrapping material and means for cyclically subdividing the draped filler at a predetermined frequency into a series of discrete rod-shaped articles each of which contains at least one batch and at least some fibrous material of the second type. The switching unit can comprise means for generating a sequence of incremental timing pulses during that portion at least of each cycle when the monitoring means monitors a batch, and the first unit then includes means for converting into first signals those second signals which are generated simultaneously with the timing pulses. Alternatively, the switching unit can comprise means for generating indexing pulses at the aforementioned frequency and means for transmitting to the first unit incremental timing pulses at least during that portion of each cycle when the monitoring means monitors a batch. The first unit comprises means for converting into first signals those second signals which are generated simultaneously with incremental timing pulses and contemporaneously with the monitoring of the batch-containing portions of the filler. The means for transmitting incremental timing pulses can comprise a rotary disc and means for generating the incremental timing pulses during a portion of each revolution of the disc or during each and every stage of such revolution.

If the means for transmitting incremental timing pulses is designed to transmit such incremental timing pulses without interruptions, the switching unit preferably further comprises selector means (e.g., a gate circuit) for effecting the transmission to the first unit of those second signals which are generated simultaneously with incremental timing pulses while the monitoring means monitors the batch-containing portions of the filler. The selector means can comprise means for transmitting, during each cycle, to the first unit those second signals which are generated simultaneously with a preselected number of incremental timing pulses, namely a number which is less than the total number of timing pulses per cycle.

The switching unit can comprise at least one threshold comparator whose input is connected with the monitoring means, presetting means for selecting the threshold of the comparator so that the latter can effect the transmission of a selected number of second signals, and means (e.g., a memory and a logic circuit in the form of an AND gate or the like) for connecting the output of the comparator with the first unit so that the latter receives second signals until such time when the comparator terminates or interrupts or effects the termination of transmission of the selected number of second signals.

The first unit can include means for averaging the second signals which are generated while the monitoring means monitors a batch-containing portion of the filler.

The monitoring means, or at least that part of the monitoring means which generates signals for transmission to the first unit, can comprise means for monitoring the permeability of successive increments of the batch-conveying means and of the fibrous material on such conveying means.

The conveying means can comprise a foraminous conveyor and the monitoring means can include means for directing radiation across the path of the filler (e.g., downstream of the region where the filler is draped into a web of cigarette paper or the like) and means for ascertaining the intensity of radiation which penetrates through successive increments of the filler in the path (such intensity is indicative of or is proportional to the density of the corresponding increments of the filler). In such apparatus, the means for generating first signals can comprise means for monitoring the permeability of successive increments of the conveyor and of the fibrous material thereon, either upstream of the delivering means or in the region where the delivering means supplies fibrous material of the second type.

For example, the conveying means can comprise an endless foraminous belt conveyor having an elongated portion (e.g., a straight flight) extending along the path and a suction chamber which is adjacent to one side of the elongated portion. The accumulating means is then arranged to deliver successive spaced-apart batches of the row to the other side of the elongated portion in a first portion or zone of the path and the delivering means is arranged to admit fibrous material of the second type to the other side of the elongated portion in a second portion or zone of the path downstream of the first zone. In such apparatus, the means for generating first signals can comprise a differential pneumatic density monitoring device which is adjacent to the first zone and serves to monitor the density of successive increments of the elongated portion of the moving conveyor and of the batches thereon. The monitoring means which generates the second signals denoting the density of successive increments of the filler is then disposed downstream of the second zone, and such monitoring means can include the aforementioned radiation source and means for monitoring the intensity of radiation which penetrates through successive increments of the filler. Flow restrictor means can be provided in a predetermined portion of the suction chamber adjacent to the first zone to reduce the suction in such predetermined portion. The pneumatic monitoring device then includes a first detector which serves to monitor the pressure in the predetermined portion of the suction chamber and a second detector which serves to monitor the pressure in the remaining portion of the suction chamber. Alternatively, the flow restrictor means can be provided in a predetermined portion of the suction chamber adjacent to that part of the second zone which is close to the first zone. The pneumatic monitoring device then includes a first pressure detector in the predetermined portion and a second pressure detector in the remaining portion of the suction chamber. Means can be provided to reduce suction in that part of the suction chamber which is immediately or closely adjacent to the accumulating means; this has been found to contribute to more satisfactory transfer of batches onto the foraminous conveyor.

The evaluating circuit can further comprise means (e.g., a comparator) for monitoring the times of arrival of the leaders of successive batches into a predetermined portion of the path and means for comparing such times with anticipated times. This evaluating circuit renders it possible to draw conclusions regarding the width of spaces between neighboring batches, the length of batches, as considered in the direction of advancement of batches along the path, and/or the presence or absence of pileups of fibrous material in the path.

The evaluating circuit can include first averaging means for generating third signals each of which is indicative of the average value of all first signals pertaining to a batch, second averaging means for generating fourth signals each of which is indicative of the average value of a predetermined number of successively generated third signals, and means for comparing each third signal with one of the fourth signals and for generating first control signals when the deviation of a third signal from the fourth signal exceeds a preselected value. The evaluating circuit which includes the just mentioned means can further comprise means for monitoring the filler downstream of the accumulating means for the presence and length of spaces between successive batches of the row, means for generating fifth signals denoting the detection of successive increments of such spaces, means for generating sixth signals which denote the average values of those fifth signals which are generated during monitoring of a space, and means for comparing the third signals with the sixth signals and for generating defect signals when the difference between a third and a sixth signal exceeds a predetermined value.

The evaluating circuit can include means for separately counting third signals which pertain to acceptable batches and third signals which pertain to defective batches.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is an enlarged fragmentary vertical sectional view as seen in the direction of arrows from the line II—II of FIG. 1;

FIG. 3 is a sectional view as seen in the direction of arrows from the line III—III of FIG. 2;

FIG. 4 is a sectional view as seen in the direction of arrows from the line IV—IV of FIG. 2;

FIG. 5 is a fragmentary plan view of a detail substantially as seen in the direction of arrow V in FIG. 2;

FIG. 8*a* shows a portion of a wrapped filler and the manner of subdividing it into rod-shaped articles of unit length;

FIG. 8*b* shows the sequence of indexing pulses which are generated cyclically in synchronism with the operation of the rod making machine;

FIG. 8*c* illustrates sequences of incremental timing pulses which are generated by an element of the evaluating circuit shown in FIG. 7;

FIG. 8*d* illustrates incremental timing pulses which are generated by an element of a modified evaluating circuit;

FIG. 8*e* is a diagram wherein the monitored density of successive increments of the filler is measured along the ordinate and the time is measured along the abscissa;

FIG. 9 illustrates a portion of a modified evaluating circuit;

DESCRIPTION OF THE PREFERRED EMBODIMENTS

Figure 1:
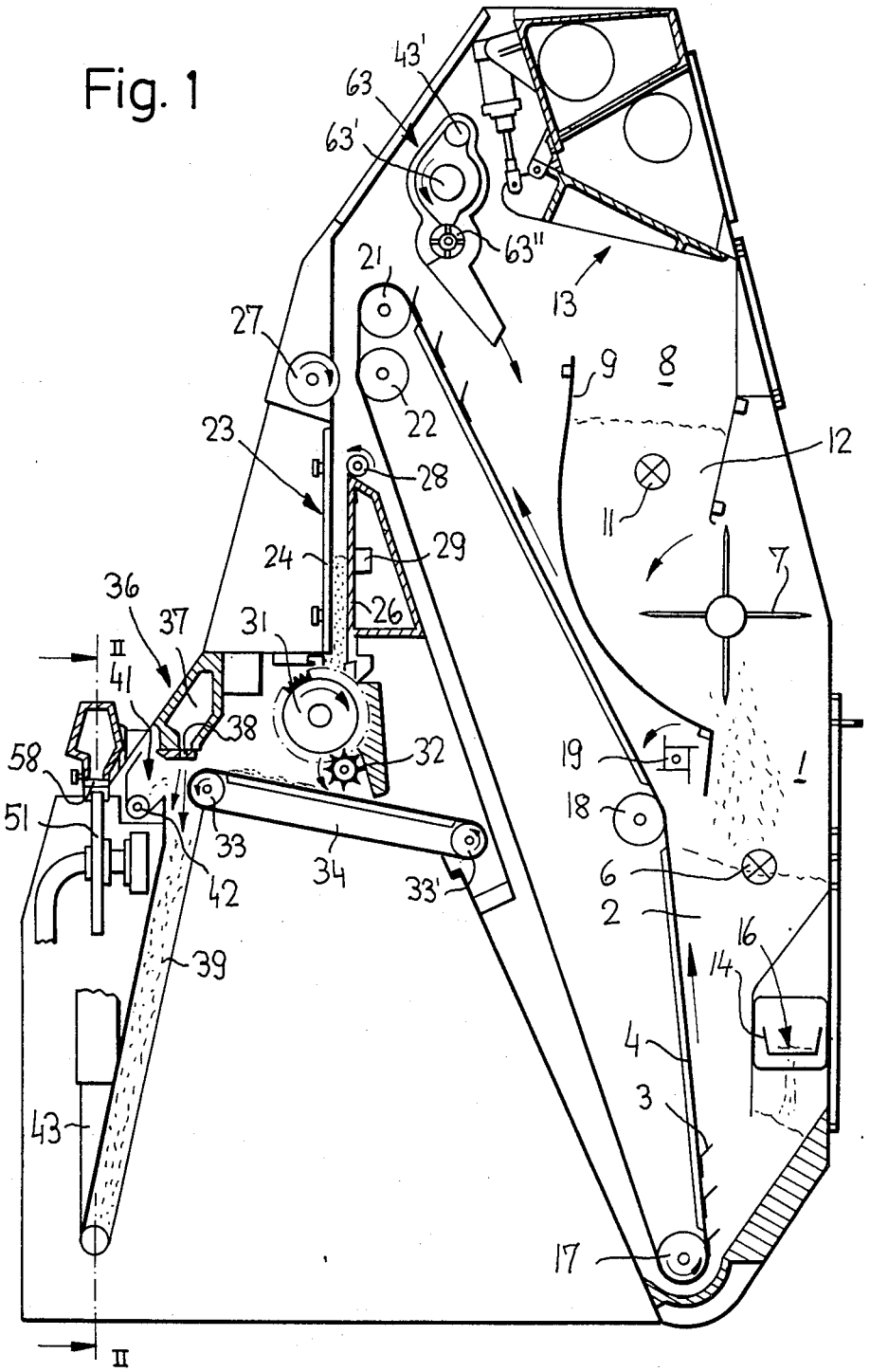
FIG. 1 is a vertical sectional view of a portion of a cigarette rod making machine and shows that part of the improved apparatus which serves to advance tobacco particles of a first type toward the filler forming or building zones.

FIG. 1 shows an apparatus for the production of a continuous tobacco filler which is moved axially at right angles to the plane of FIG. 1. The illustrated apparatus constitutes or includes the distributor of a cigarette rod making machine, e.g., a machine known as PROTOS which is manufactured and sold by the assignee of the present application. The apparatus comprises a magazine 1 for a supply 2 of tobacco particles of a first type. This magazine is adjacent to the upwardly moving flight of an endless belt conveyor 4 having equidistant tobacco entraining portions 3 and serving as a means for drawing tobacco particles from the supply 2. A photocell 6 is provided to monitor the supply 2 of tobacco particles in the magazine 1 and to control the motor for a rotary rake 7 which can deliver particles of tobacco from a supply 12 in a second magazine 8 at a level above the magazine 1. An arcuate wall 9 in the housing of the distributor separates the supply 12 of tobacco particles in the second magazine 8 from the upwardly moving flight of the conveyor 4. A second photocell 11 is provided in the magazine 8 to monitor the supply 12 and to actuate a normally closed gate 13 at the discharge end of a pneumatic conveyor system which can deliver particles of tobacco from the main source, not shown. A conveyor 14 discharges surplus tobacco 16 into the lower portion of the magazine 1. Such surplus is returned from the location close to that where the particles of tobacco which are being withdrawn by the entraining elements 3 of the conveyor 4 are admitted into the filler forming zone.

The conveyor 4 is trained over several pulleys 17, 18, 21 and 22. The pulley 17 is driven by a variable-speed motor (not shown in FIG. 1) in a counterclockwise direction. The manner in which the speed of the motor for the pulley 17 can be regulated is disclosed, for example, in commonly owned U.S. Pat. No. 4,185,644 granted Jan. 29, 1980 to Heitmann et al. The upwardly moving flight of the conveyor 4 advances past a paddle wheel 19 which is driven at a constant speed and is provided with paddles in the form of or including leather straps serving to brush off the surplus of tobacco from the pockets which are formed by the entraining elements 3. This paddle wheel is installed in the housing of the distributor at a level at least slightly above the supply 2 of tobacco particles in the magazine 1.

The pulleys 21, 22 cooperate to ensure that the uppermost portion of the downwardly moving flight of the conveyor 4 is located in an at least substantially vertical plane and is parallel to the upper portion of the front wall 24 of an upright duct 23 which can contain a reasonable supply of tobacco particles. The upper portion of the front wall 24 has an opening for a portion of a driven magnetic roller 27 serving to attract metallic particles which may be contained in the stream of tobacco descending into the duct 23 from successive pockets which are defined by the entraining elements 3. The contents of successive pockets are dumped as soon as the respective entraining elements 3 move over and begin to descend along the pulley 21. The rear wall 26 of the duct 23 is disposed at a level below a continuously driven roller 28 which rotates at a constant speed and prevents the wall 26 from intercepting descending tobacco shreds. Furthermore, the rear wall 26 carries a monitoring device 29 including a series of reflection type photocells which are disposed at different levels and are distributed across the width of the duct 23, as considered at right angles to the plane of FIG. 1. The photocells of the monitoring device 29 are electrically connected with each other as well as with the control circuit for the motor which drives the pulley 17 for the conveyor 4. The connections between such photocells and the control circuit for the motor which drives the conveyor 4 preferably contain time-delay elements which ensure that the speed of the motor is adjusted only after the photocell which has generated a signal denoting that the height of the column of tobacco particles in the duct 23 is excessive remains buried in the supply of tobacco particles for a certain interval of time. The purpose of the monitoring device 29 is to ensure that the level of the top surface of tobacco supply in the duct 23 remains constant or fluctuates within a rather narrow range because this guarantees a more uniform rate of withdrawal of tobacco particles from the lower end portion of the duct. A monitoring device which can be used for such purposes is disclosed in detail in commonly owned U.S. Pat. No. 4,037,712 granted July 26, 1977 to Waldemar Wochnowski.

The means for withdrawing tobacco particles from the lower end of the duct 23 comprises a drum-shaped carded conveyor 31 which is driven at a variable speed by the main prime mover 138 (FIG. 11) of the cigarette rod making machine through the medium of a variable-speed transmission (not shown) to rotate in a clockwise direction, as viewed in FIG. 1, and draws a continuous layer of fibrous material into the range of a rapidly rotating picker roller 32. The latter serves to expel the fibrous material from the carding of the conveyor 31 and to propel the expelled fibrous material onto the upper reach of an apron conveyor 34 which is trained over pulleys 33 and 33'. The picker roller 32 is driven at a constant speed in a counterclockwise direction, as viewed in FIG. 1. The apron conveyor 34 is also driven at a constant speed and serves to propel successive increments of a more or less homogeneous layer of fibrous material on its upper reach into the range of a classifying device 36. In order to increase friction (i.e., to reduce the likelihood of slippage of tobacco particles on the upper reach of the apron conveyor), the external surface of the conveyor 34 is preferably profiled (e.g., it can be provided with transversely extending ribs made of rubber or other friction generating material) so that the transport of successive increments of the tobacco layer on the apron conveyor 34 into the range of the classifying device 36 takes place at a predictable rate.

The classifying device 36 of the distributor which is shown in FIG. 1 comprises a plenum chamber 37 which is connected to the outlet of a suitable source of compressed gaseous fluid (preferably an air compressor or the like) and whose bottom wall is formed with a row of closely adjacent orifices 38 for the discharge of discrete narrow vertically or nearly vertically downwardly oriented streams of compressed gaseous fluid (normally air). The streams of such fluid together form a thin air curtain which is traversed by the heavier tobacco particles (such as fragments of tobacco ribs whose inertia is high) but which is capable of changing the direction of movement of more desirable lightweight tobacco particles, particularly shreds. The air curtain fails to change the trajectories of heavier tobacco particles so that such particles are propelled across the curtain and enter an intercepting receptacle 41 the bottom portion of which contains an intermittently or continuously driven feed screw 42 for evacuation of accumulated unsatisfactory material when the need arises. The evacuated material can be delivered to a tobacco puffing machine or to a machine for the making of sheets of reconstituted tobacco. The air curtain which is formed by streams of compressed air issuing from the orifices 38 of the plenum chamber 37 is closely adjacent to the discharge end of the apron conveyor 34, i.e., to the pulley 33.

The lighter tobacco particles which are deflected by the air curtain descend into a downwardly extending tobacco conveying conduit 39 whose discharge end communicates with the lower end of an upwardly extending second tobacco conveying conduit 43. As can be seen in FIG. 2, the inlet of the conduit 43 is connected with the outlet of a blower 44 which admits into the conduit 43 a stream of compressed air serving to transport satisfactory tobacco particles toward the periphery of a hollow rotary drum-shaped conveyor 51 (hereinafter called suction wheel). The manner in which the conduits 39 and 43 are connected with each other is disclosed, for example, in commonly owned U.S. Pat. No. 4,155,367 granted May 22, 1979 to Willy Rudszinat.

The upwardly extending conduit 43 comprises an arcuate section 46 the lower part of which has a circular or substantially circular cross-sectional outline (see FIG. 3). The particles of tobacco which are conveyed in the conduit 43 by the air stream issuing from the blower 44 form a stream 47 (see FIGS. 2 and 3) which travels along a portion of the internal surface of the conduit 43 and upwardly toward the periphery of the suction wheel 51. The formation of the stream 47 in the conduit 43 is attributable primarily to centrifugal force.

A portion of the suction wheel 51 extends into the arcuate section 46 of the conduit 43. The peripheral surface of this suction wheel is formed with elongated recesses or pockets 48 each of which can accumulate an elongated batch 49 of tobacco particles. A portion of the section 46 of the conduit 43 is formed with a relatively narrow channel 52 (see FIG. 4) which conveys a narrow tobacco stream 47' in a direction toward the periphery of the rotating suction wheel 51. The channel 52 extends substantially radially of the suction wheel 51 and terminates short of the latter's peripheral surface so that the conduit 43 defines an edge 54 beyond which the particles of tobacco forming the stream 47' are propelled under the action of suction in the pockets 48 as well as due to inertia and under the action of the stream of compressed air issuing from the blower 44. The edge 54 is located at a transfer station 53 where the particles of tobacco leave the conduit 43 to advance toward and into the oncoming pockets 48 of the suction wheel 51. Conversion of the relatively wide tobacco stream 47 in the lower part of the conduit section 46 into a much narrower tobacco stream 47' in the channel 52 of the conduit 43 is desirable and advantageous because this ensures a highly predictable propulsion of tobacco particles beyond the edge 54 and toward and into the oncoming pockets 48. The width of the channel 52 preferably matches or closely approximates the width of the pockets 48, as considered in the axial direction of the suction wheel 51, i.e., at right angles to the plane of FIG. 2. The conduit 43 sealingly surrounds a substantial portion of the suction wheel 51 in a region above and to the left as well as to the right of the propelling edge 54, as viewed in FIG. 2, through a distance which at least slightly exceeds the length of a pocket 48, as considered in the circumferential direction of the suction wheel 51. The corresponding portions of the conduit 43 are in or close to sealing engagement with the end faces of the suction wheel 51.

The rotor of the suction wheel 51 is formed with suction ports 56 which communicate with the respective pockets 48 as well as, at times, with a suction chamber 57 which is provided in the interior of the suction wheel 51 and serves to attract growing and fully formed batches 49 of tobacco particles in the pockets 48 during transport from the transfer station 53 toward a second transfer station 59 where the fully grown batches 48 are taken over by the underside of the lower flight of a foraminous endless belt conveyor 58. The suction chamber 57 within the confines of the rotor of the suction wheel 51 is connected with a suction generating device 256 (see FIG. 6) by an adjustable suction regulating valve 257 which is installed in a suction pipe 57'. The manner in which the valve 257 is adjusted in accordance with a feature of the invention will be described with reference to FIGS. 6 and 7.

The lower flight of the foraminous belt conveyor 58 extends substantially tangentially of the suction wheel 51. In the region of the transfer station 59 for delivery of batches 49 onto the conveyor 58, the suction wheel 51 is formed with a stationary channel 61 which communicates with the atmosphere or is connected with a source of slightly compressed air or another suitable gaseous fluid so as to facilitate and/or even promote the transfer of batches 49 onto the conveyor 58.

That portion of the section 46 of the conduit 43 which is remote from the channel 52 and from the path of pockets 48 in the peripheral surface of the suction wheel 51 extends toward, past and well beyond the suction wheel so as to define a relatively large compartment for a trimming or equalizing device 62 serving to remove the surplus from batches 49 in successive pockets 48 and to thus ensure that each and every batch 49 contains the same or nearly the same quantity of tobacco particles. That portion of the wall of the section 46 of conduit 43 which extends along and beyond the suction wheel 51 is denoted by the reference character 46'. As can be seen in FIG. 2, the particles of tobacco which are propelled beyond the edge 54 of the conduit 43 but do not happen to enter a pocket 48 are entrained into the discharge end 43' of the conduit 43 and bypass the trimming device 62. In the embodiment of FIG. 2, the trimming device 62 comprises a knife 62' which is adjacent to the periphery of the continuously rotating suction wheel 51 and a rotary brush 62'' serving to remove that surplus which extends beyond the edge of the knife 62' in a direction away from the periphery of the suction wheel 51. The suction wheel 51 is driven to rotate in a counterclockwise direction, as viewed in FIG. 2, and the trimming device 62 is disposed between the transfer stations 53 and 59, i.e., downstream of the station 53 (as considered in the direction of rotation of the suction wheel) but upstream of the station 59.

As can be seen in the upper portion of FIG. 1, the discharge end 43' of the conduit 43 is located in the housing of the distributor at a level above the magazine 8 and discharges tobacco into a sluice 63 which contains a rotary drum-shaped tobacco separator 63' and a cell wheel 63'' which admits tobacco particles (which have been separated from the gaseous carrier medium) into the magazine 1 or 8.

The lower flight of the conveyor 58 is disposed at a level below an elongated suction chamber 64 having an outlet 66 which is connected with a suction generating device 66'. The chamber 64 serves to attract the batches 49 to the underside of the lower flight of the conveyor 58. Successive increments of such lower flight advance first along a first or primary filler forming zone 67 where the growing filler merely contains a row of spaced-apart batches 49, and thereupon along a second or secondary filler forming zone 68 where the spaces 49' between successive batches 49 are filled with tobacco particles of a second type and where at least some particles of the second type can or do deposit at the undersides of the batches 49. The particles of the second type are showered upwardly by way of a duct 70 which is located downstream of and is spaced apart from the suction wheel 51, as considered in the direction of travel of the lower flight of the conveyor 58. The fully grown filler is shown at 69 (see FIG. 6). When the surplus 69' is removed by a suitable trimming or equalizing device 71, the thus obtained finished (trimmed or equalized) filler **69*f* (shown in the left-hand portion of FIG. 6) contains batches 49 which alternate with filler portions 49A. The portions 49A fill the spaces 49' between neighboring batches 49**.

Figure 6:
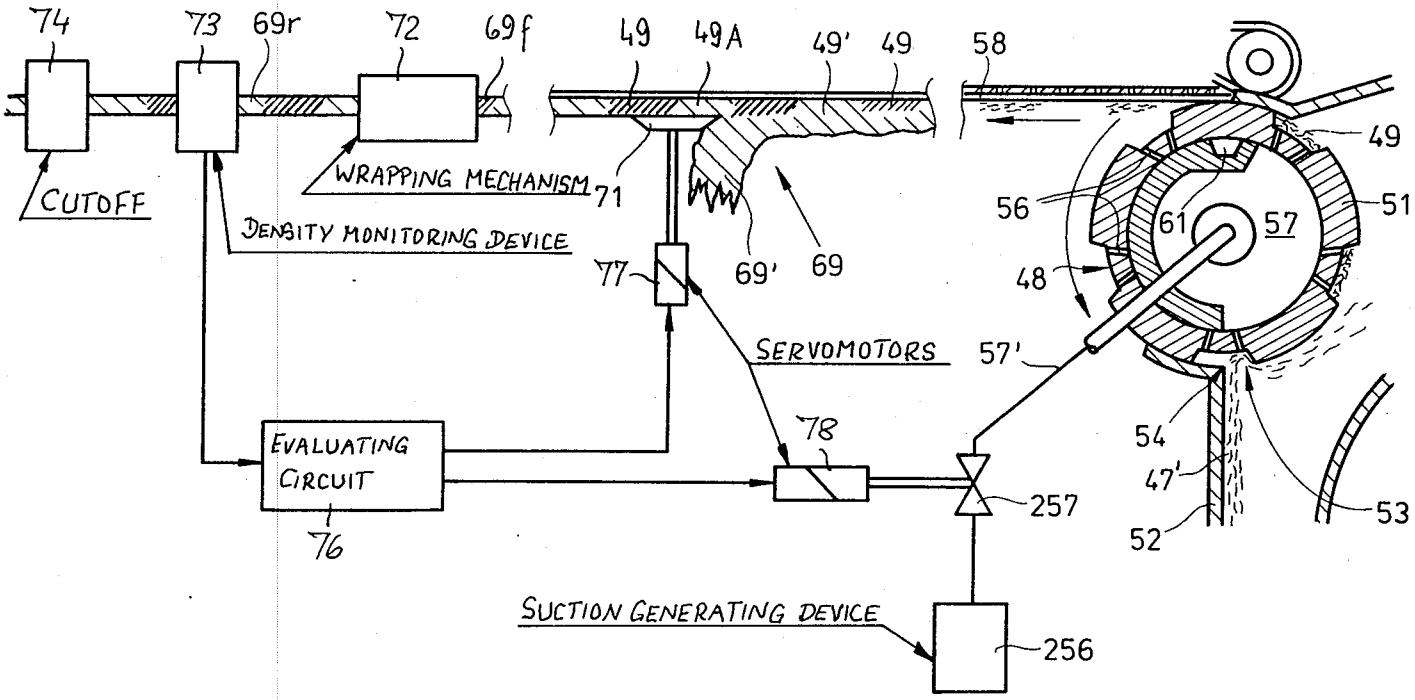
FIG. 6 shows a portion of the structure which is illustrated in FIG. 2 and schematically illustrates the means for converting the filler and a web of wrapping material into a series of discrete rod-shaped articles.

The manner in which the finished filler **49*f* is processed in the cigarette rod making machine is shown schematically in the left-hand portion of FIG. 6. The filler 49*f* is caused to advance through a conventional wrapping mechanism 72 wherein it is draped into a web of cigarette paper or other suitable wrapping material to be converted into a cigarette rod 69*r* which is thereupon severed at regular intervals by a suitable cutoff 74 so that it yields a file of discrete plain cigarettes of unit length or multiple unit length. Each plain cigarette contains at least a portion of at least one of the batches 49 and at least a part of at least one filler portion 49A**.

The surplus 69' is returned to the source which supplies tobacco particles of the second type into the duct 70.

The end portion 43' and the sluice 63 can deliver surplus tobacco particles of the first type into the conveyor 14, i.e., the surplus which is removed by the trimming device 62 and/or which has failed to enter a pocket 48 of the suction wheel 51 can constitute the surplus 16 which is shown in FIG. 1.

Before the cigarette rod **69*r* reaches the cutoff 74, it passes through a monitoring device 73 whose output is connected with an evaluating circuit 76 shown in FIG. 6. The output of the evaluating circuit 76 is connected with an adjusting device 77 for the trimming device 71 which removes the surplus 69' from the filler 69, and with an adjusting device 78 for the valve 257 which regulates the pressure in the suction chamber 57 of the suction wheel 51. Each of the adjusting device 77, 78 can constitute a suitable servomotor. The servomotor 77 is designed to change the level or levels of the cutter or cutters of the trimming device 71, and the servomotor 78 serves to regulate the extent to which the valve 257 permits the suction chamber 57 to communicate with the suction generating device 256**.

Figure 7:
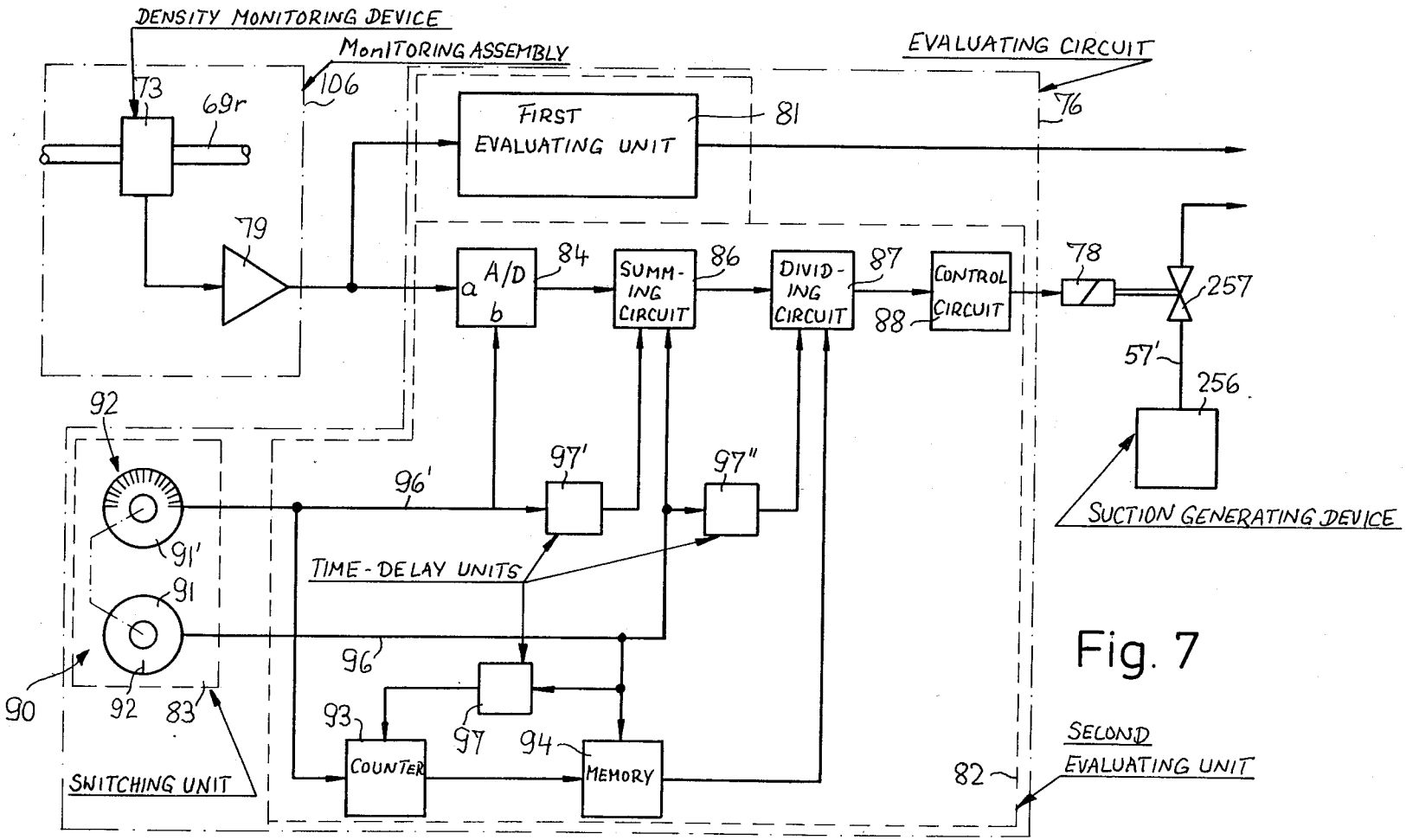
FIG. 7 illustrates the details of an evaluating circuit which is used in the apparatus of FIG. 6.

The details of one presently preferred embodiment of the evaluating circuit 76 are shown in FIG. 7. The output of the monitoring device 73 is connected with two inputs of the evaluating circuit 76 by a signal amplifier 79. The amplified signal is transmitted to a first circuit arrangement (first evaluating unit) 81 as well as to the input a of an analog-digital converter 84 forming part of a second circuit arrangement (evaluating unit) 82. In addition to the units 81 and 82, the evaluating circuit 76 further comprises a switching unit 83 which is connected with the second evaluating unit 82.

The first evaluating unit 81 serves to transmit control signals to the servomotor 77 for the trimming device 71 and may be of the type known as SRM (manufactured and sold by the assignee of the present application). Evaluating units of the type SRM are used in existing cigarette rod making machines to adjust the trimming device which removes the surplus from conventional filler, i.e., from a filler which contains only one type of tobacco or which contains a core consisting of a first type of tobacco and a tubular or substantially tubular envelope or shell consisting of a second type of tobacco.

The second evaluating unit 82 is disposed in parallel with the unit 81 and its output transmits control signals to the servomotor 78 which adjusts the valve 257 so that the latter can regulate the pressure in the suction chamber 57 of the suction wheel 51. The aforementioned analog-digital converter 84 of the second evaluating unit 82 is connected in series with a summing or totalizing circuit 86, a dividing circuit 87 and a control circuit 88. The evaluating unit 82 is further connected with the aforementined switching unit 83 which, in the embodiment of FIG. 7, comprises a first timing disc 91 and a second timing disc 91'. The timing discs 91, 91' are coupled to each other and are driven in synchronism with the prime mover 138 of the cigarette rod making machine. The first timing disc 91 is designed to transmit one timing pulse P (FIG. **8*b*) per revolution. On the other hand, the timing disc 91' is designed to transmit a substantial number of incremental timing pulses I (FIG. 8c) during a predetermined portion (in FIG. 7 one-half) of each of its revolutions. The means which are provided on or associated with the timing discs 91 and 91' to generate the respective timing pulses P and I are denoted by short lines 92** adjacent to the peripheries of the respective timing discs.

The incremental timing pulses I which are furnished by the timing disc 91' are transmitted to the timing input b of the analog-digital converter 84 as well as to one input of the summing circuit 86. The indexing or timing pulses P which are generated by the timing disc 91 are transmitted via conductor 96 to a further input of the summing circuit 86 as well as to one input of the dividing circuit 87.

The second evaluating unit 82 further comprises a timing pulse counter 93 as well as a modular memory 94. One input of the pulse counter 93 is connected with the timing disc 91' and its output is connected with one input of the memory 94. A second input of the memory 94 is connected with the timing disc 91 by way of the conductor 96. The character 96' denotes in FIG. 7 the conductor which transmits incremental timing pulses I from the disc 91' to the pulse counter 93, analog-digital converter 84 and summing circuit 86. A time-delay unit 97' in the conductor 96' connects the timing disc 91' with the corresponding input of the summing circuit 86, and a second time-delay unit 97'' connects the conductor 96 with the corresponding input of the dividing circuit 87. The reference character 97 denotes a time-delay unit which is provided in the conductor 96 between the timing disc 91 and the second input of the counter 93.

The mode of operation of the improved apparatus and particularly of the evaluating circuit 76 will be described with reference to FIGS. 7, 8a, 8b and 8c. FIG. 8a shows a length of the trimmed and wrapped filler (rod 69r) which is composed of alternating batches 49 and portions 49A in the spaces 49' between neighboring batches, and of a web of cigarette paper or other wrapping material which surrounds the trimmed filler 69f and forms therewith the rod 69r. The lines $S_1$ and $S_2$ denote two of the locations where the cigarette rod 69r is severed by the cutoff 74 to yield plain cigarettes of double unit length. The plain cigarettes of double unit length are subsequently severed at the locations $M_1$ and $M_2$ so that each thereof yields two plain cigarettes of unit length. Severing at the locations $M_1$ and $M_2$ can take place in a filter tipping machine wherein the plain cigarettes are assembled with filter mouthpieces to form therewith filter cigarettes of unit length or multiple unit length. FIG. 8a further shows that each plain cigarette of unit length contains one-half of a batch 49 and one-half of a filler portion 49A.

FIG. 8b shows the frequency of timing pulses P which are generated by the timing disc 91. The frequency of pulses P is the same as the frequency of machine cycles (each machine cycle involves the making of a plain cigarette of double unit length), i.e., the cutoff 74 severs the cigarette rod 69r once during each machine cycle. Therefore, the pulses P which are shown in FIG. 8b are in register with the lines $S_1$ and $S_2$ of FIG. 8a. In other words, the timing of the generation of indexing pulses P by the timing disc 91 coincides with the timing of cuts which are performed by the knife or knives of the cutoff 74 in order to subdivide the leader of the continuously advancing cigarette rod 69r into a file of discrete plain cigarettes of double unit length.

FIG. 8c shows the frequency of incremental timing pulses I which are generated by the timing disc 91' during one-half of each revolution of this disc. The pulses P are transmitted by the conductor 96, and the pulses I are transmitted by the conductor 96'.

It is now assumed that the monitoring device 73 includes a source of corpuscular radiation at one side and an ionization chamber or another suitable transducer at the other side of the path of movement of the cigarette rod 69r between the wrapping mechanism 72 and the cutoff 74. The ionization chamber is located opposite the source of corpuscular radiation and its output continuously transmits an analog signal which is indicative of the intensity of radiation that has passed through successive increments of the trimmed filler 69f, i.e., such signal is indicative of density of the corresponding increments of the filler 69f. The analog density signal which is transmitted by the ionization chamber of the monitoring device 73 is amplified at 79 and is transmitted to the corresponding inputs of the evaluating units 81 and 82. The evaluating unit 81 converts the incoming analog signal into a continuous series of digital signals, it averages predetermined numbers of successive digital signals, it compares the thus obtained averaged signals with a reference signal, it generates a control signal in the event of deviation of an averaged signal from the reference signal, and it transmits the control signal to the servomotor 77 which adjusts the trimming device 71 accordingly. The adjustment of the trimming device 71 is such that the density of the finished filler 69f in the cigarette rod 69r remains at least substantially constant or returns to an optimum or preselected value with a minimum of delay in response to signals from the output of the evaluating unit 81. This phase of regulation, including the generation of signals by the monitoring device 73, processing of such signals in the evaluating unit 81 and utilization of the thus obtained control signals to adjust the trimming device 71 via servomotor 77, is known per se and, therefore, need not be explained in greater detail.

The analog signal which is amplified by the amplifier 79 is further transmitted to the input a of the analog-digital converter 84. When the input b of the converter 84 receives an incremental timing pulse I via conductor 96', its output transmits a signal to the corresponding input of the summing circuit 86. The latter totalizes all signals which are received from the converter 84 while the timing disc 91' generates a sequence of incremental timing pulses I, i.e., while the disc 91' completes that half of its revolution which entails the transmission of incremental timing pulses I via conductor 96'. As can be seen in FIGS. 8b and 8c, the mode of operation of the timing disc 91' is such that it transmits incremental timing pulses I via conductor 96' during each interval when the monitoring device 73 generates signals denoting the density of a batch 49. In other words, the timing disc 91' begins to transmit incremental timing pulses I as soon as the leader of a batch 49 enters the range of the monitoring device 73 and the disc 91' ceases to transmit timing pulses I as soon as the trailing end of such batch 49 has advanced beyond the monitoring device 73. The analog-digital converter 84 then ceases to transmit signals to the summing circuit 86, i.e., the evaluating operation of the unit 82 is interrupted for an interval of time which elapses while the monitoring device 73 transmits signals in response to monitoring of the density of a filler portion 49A. Thus, the summing circuit 86 totalizes all of the incremental timing pulses I which are transmitted by the conductor 96' during a full revolution of the timing disc 91'.

The memory 94 is activated by the pulse P which is generated when the cutoff 74 severs the cigarette rod 69r along the line $S_1$ of FIG. 8a, and such pulse P is further used to reset the counter 93. Upon generation of such signal P, the timing disc 91' must complete one-fourth of a revolution before it resumes the transmission of incremental timing pulses I (compare FIGS. 8b and 8c) which are counted by the counter 93. The latter transmits to the memory 94 a signal which is indicative of the sum of timing pulses I during the respective half of the revolution of the timing disc 91' and the output of the memory 94 transmits a signal to the corresponding input of the dividing circuit 87. The latter also receives a signal from the summing circuit 86, and such signal is indicative of the sum of pulses I during one-half of the revolution of the timing disc 91'. The output of the dividing circuit 87 transmits a signal denoting the average value of signals which are generated during monitoring of a batch 49. The signal denoting such average value is transmitted to the input of the control circuit 88 which can be identical with or analogous to the evaluating unit 81, i.e., it averages the incoming signals, it compares the averaged signal with a reference value, and it transmits to the servomotor 78 control signals denoting the differences between the intensities or other characteristics of signals which transmitted by the dividing circuit 87 and the reference signal. The servomotor 78 adjusts the valve 257 accordingly to thereby influence the density of the batches 49 since the pressure in the suction chamber 57 of the suction wheel 51 directly influences the quantity of tobacco particles which are admitted into and retained in successive pockets 48 of the suction wheel.

It will be noted that the timing disc 91', which generates incremental timing pulses I only during that stage of each of its revolutions when the monitoring device 73 monitors the characteristics of a batch 49, i.e., which generates pulses I in synchronism with the transport of batches 49 past the monitoring station and hence in synchronism with the operation of the machine (signals P in FIG. 8b), renders it possible to segregate or separately evaluate all such signals coming from the ionization chamber of the device 73 and from the output of the amplifier 79 which are indicative of a parameter (density) of the batches 49. This provides a very simple but reliable mode of influencing a parameter (density) of the batches 49 during the formation of such batches on the suction wheel 51 by adjusting the pressure in the suction chamber 57. In other words, the characteristics of the batches 49 can be influenced during their formation which entails considerable savings in the outlay for components and reduces the amounts of surplus tobacco which must be removed by the trimming device 62.

The time-delay units 97, 97' and 97'' serve to ensure adequate synchronization of the intervals of transmission of timing pulses with the intervals of transmission of density signals in the components of the evaluating circuit 76. The pulse P which is generated by the timing disc 91 resets the summing circuit 86 via conductor 96 after the summing circuit completes a totalizing operation, and such pulse further serves to activate the dividing circuit 87 so that the latter is ready to receive the signal from the output of the summing circuit 86 as well as the signal from the output of the memory 94.

An important advantage of the method which can be carried out with the apparatus which includes the evaluating circuit 76 is that it allows for highly accurate adjustment of the density of the finished filler 69f and for an equally accurate regulation of density of the batches 49. Mere regulation of the position of the trimming device 71 relative to the conveyor 58 would not suffice to ensure any appreciable regulation of the density of the batches 49, and mere regulation of the pressure in the suction chamber 57 would not suffice to effect a predictable and sufficient regulation of the density of the entire filler.

The switching unit 83 is capable of normally ensuring the transmission of density-denoting (second) signals to the evaluating unit 81 with a high degree of accuracy because, as a rule, the length of each batch 49 matches an optimum length and the width of the spaces 49' between neighboring batches 49 also matches a predetermined value. Therefore, the timing of the generation of pulses I can be readily selected in such a way that they coincide with the monitoring of those portions of the filler 69f which contain the batches 49.

An advantage of the feature that the control signals which are transmitted by the evaluating unit 81 influence the density of the filler 69f and the control signals which are transmitted by the control circuit 88 of the evaluating unit 82 influence the density of the batches 49 is that density is a readily definable parameter and also that density can be influenced in a number of different ways. Thus, density of the filler can be influenced by varying the rate of removal of excess 69', and density of the batches 49 can be influenced by regulating the pressure in the chamber 57.

FIG. 9 shows a modified switching unit 83' which comprises a first timing disc 91 corresponding to the timing disc 91 of FIG. 7 and a second timing disc 91a which is coupled with the timing disc 91 and transmits incremental timing pulses I' (see FIG. 8d) during each cycle of the machine. For example, the timing disc 91a transmits onehundredtwentyeight incremental timing pulses I' during the interval between the transmission of two successive timing pulses P via conductor 96. The switching unit 83' further comprises a counter 98, two comparators 99, 99' which are connected with the counter 98, and presetting devices 101, 101' for the respective comparators. The outputs of the comparators 99, 99' are connected with the corresponding inputs of a memory 102 whose output is connected with one input of an AND gate 103. The other input of the AND gate 103 is connected with the timing disc 91a via conductor 96''. The output of the AND gate 103 is connected with the input of the evaluating unit 82 of FIG. 7 via conductor 96'.

As can be seen in FIG. 8d, the timing disc 91a transmits incremental timing pulses I' during the entire machine cycle, i.e., during the entire interval between successive cuts by the cutoff 74 across the running cigarette rod 69r. As mentioned above, the timing disc 91a is assumed to transmit onehundredtwentyeight timing pulses I' during the interval which elapses between the generation of two successive indexing pulses P (by the timing disc 91), i.e., between the making of a cut along the line $S_1$ and the making of a cut along the line $S_2$ of FIG. 8a. In other words, each double-unit-length section of the trimmed filler 69f causes the generation of onehundredtwentyeight timing pulses I'.

The mode of operation of the evaluating circuit which includes the switching unit 83' of FIG. 9 is as follows:

Each indexing pulse P entails a resetting of the counter 98 via conductor 96 so that it can count the pulses I' which are transmitted thereto via conductor 96''. The presetting device 101 is adjusted to select a number of pulses I' which are to be generated during the interval between the making of the cut along the line $S_1$ (i.e., between the generation of a pulse P) and the arrival of the leading end of an oncoming batch 49 at the monitoring station (monitoring device 73). In the illustrated embodiment, the number of pulses I' which are generated during such interval is thirtytwo, i.e., one-fourth of the total number of pulses I' per revolution of the timing disc 91*a*. The presetting device 101' is adjusted to set the comparator 99' in such a way that the latter transmits to the memory 102 a signal when the number of incremental timing pulses I' which are generated by the timing disc 91*a* during the interval between the generation of a pulse P and the advancement of the trailing end of a batch 49 beyond the monitoring station (at 73) equals ninetysix.

The comparator 99 transmits to the memory 102 a signal as soon as the timing disc 91*a* transmits thirtytwo timing pulses I' following the generation of an indexing pulse P by the disc 91, and such signal from the comparator 99 activates the memory 102. The memory 102 then transmits a signal to the corresponding input of the AND gate 103 so that the output of the gate 103 transmits (via conductor 96') a signal whenever its second input receives a signal (pulse I') via conductor 96''. As mentioned above, the conductor 96' of FIG. 9 transmits the signals from the AND gate 103 to the evaluating unit 82 of the evaluating circuit 76 which is shown in FIG. 7. In other words, the evaluating unit 82 is again in a position to evaluate signals (generated in response to transmission of pulses I' Nos. thirtythree, thirtyfour, etc.) which are indicative of a parameter (density) of a batch 49. The mode of operation of the evaluating unit 82 in response to signals from the AND gate 103 is the same as described in connection with FIG. 7, i.e., the output of the AND gate 103 is connected with the input b of the analog-digital converter 84, with the time-delay unit 97' and with the counter 93.

When the counter 98 receives a total of ninetysix incremental timing pulses I', the comparator 99' transmits a signal which deactivates the memory 102 so that the AND gate 103 ceases to transmit signals to the evaluating unit 82. In other words, evaluation of density signals by the unit 82 is terminated as soon as the trailing end of a batch 49 advances beyond the monitoring station (73). It will be noted that the evaluating circuit which embodies the switching unit 83' of FIG. 9 is also capable of simultaneous evaluation of a parameter (density) of the finished filler 69*f* and of a parameter (density) of each of the row of successive batches 49 in the finished filler. Otherwise stated, the switching unit 83' enables the evaluating unit 82 to evaluate only those signals, generated by the monitoring device 73, which pertain to the batches 49.

Figure 10:
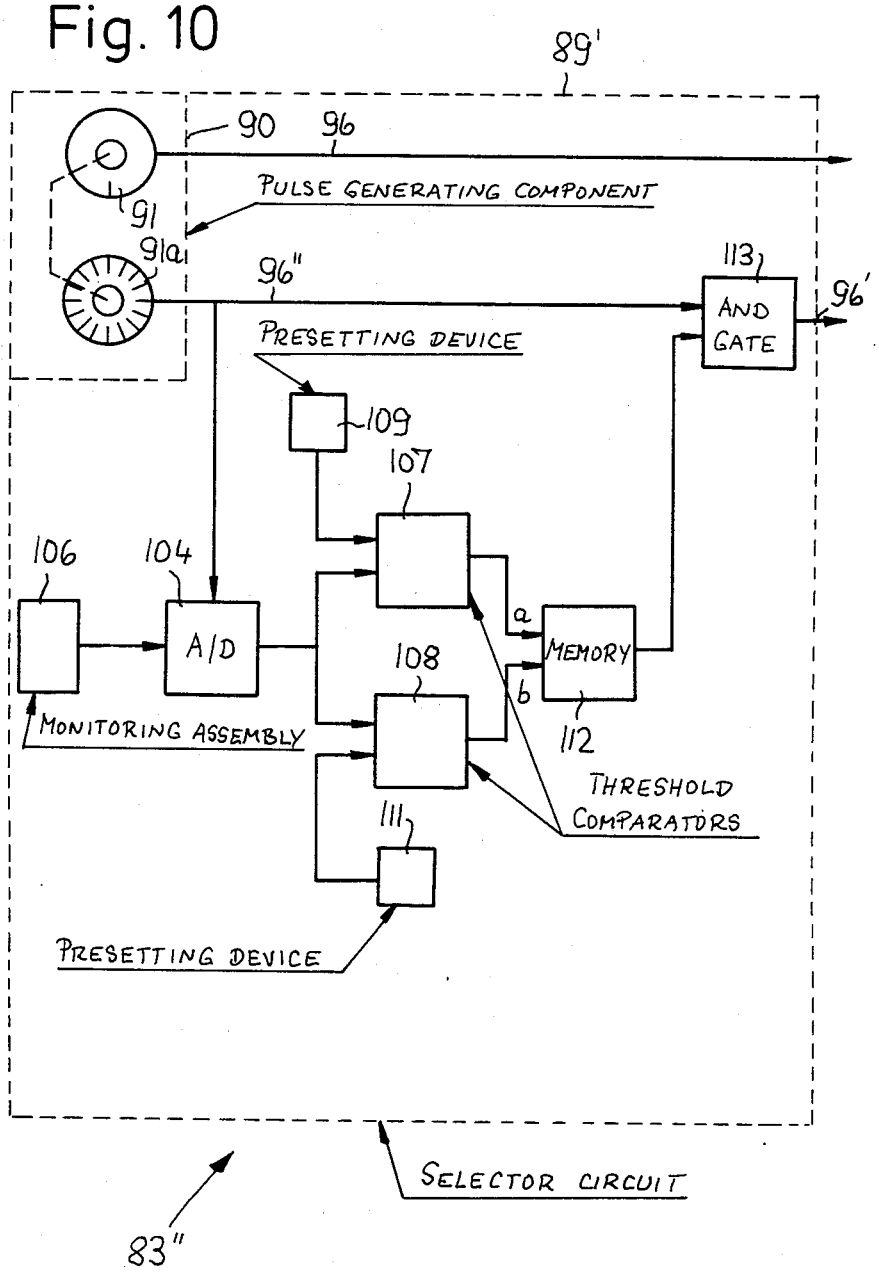
FIG. 10 shows a portion of a third evaluating circuit.

FIG. 10 shows a third switching unit 83'' which again employs a timing disc 91 corresponding to the similarly referenced timing disc of FIG. 7 and serving to transmit pulses P at a frequency corresponding to that of the machine cycles. The second timing disc 91*a* of the switching unit 83'' operates in the same way as the similarly referenced timing disc of the switching unit 83', i.e., it transmits onehundredtwentyeight incremental timing pulses I' per machine cycle. The conductor 96'' transmits such timing pulses to the corresponding input of an analog-digital converter 104 another input of which is connected to the output of a monitoring assembly 106 including the monitoring device 73 and amplifier 79 (see the upper left-hand portion of FIG. 7). The output of the analog-digital converter 104 is connected with the corresponding inputs of two threshold comparators 107, 108 which are connected in parallel and which are further connected with presetting devices 109, 111, respectively. The output of the comparator 107 is connected to the setting input a and the output of the comparator 108 is connected with the resetting input b of a modular memory 112 whose output is connected to one input of a AND gate 113. The other input of the AND gate 113 receives incremental timing pulses I' from the timing disc 91*a* via conductor 96'', and the output of the AND gate 113 transmits signals to the second evaluating unit 82 of the evaluating circuit 76 via conductor 96'.

The switching unit 83'' of FIG. 10 also allows for simultaneous monitoring of a parameter (density) of the finished filler 69*f* and of a parameter (density) of each batch 49. In other words, the switching unit 83'' enables the evaluating unit 82 of FIG. 7 to evaluate those portions of the signal which is generated by the assembly 106 which are obtained during monitoring of the batches 49. Thus, the analog signal which is transmitted by the assembly 106 is digitalized by the converter 104 which transmits a continuous series of digital signals to the corresponding inputs of the threshold comparators 107 and 108. The manner in which the assembly 106 generates signals in response to monitoring of the filler 69*f* is shown in FIG. 8*e*. The curve portions $D_1$ denote those portions of the density signal which are generated in response to monitoring of successive filler portions 49A, and the curve portions $D_2$ denote those portions of the density signal curve which are generated in response to monitoring of the batches 49. The purpose of the threshold comparators 107 and 108 is to enable the evaluating circuit which embodies the switching unit 83'' of FIG. 10 to discriminate between those portions of the density signal (D) which are generated in response to monitoring of the filler portions 49A and those portions of the density signal which are generated in response to monitoring of the batches 49. The presetting devices 109 and 111 are adjusted to transmit signals $D_s$ (see FIG. 8*e*). When the value of $D_s$ is exceeded because the leader of a batch 49 has arrived at the monitoring station (73), the comparator 107 transmits a signal to the setting input a of the memory 112. The latter then transmits a signal to the corresponding input of the AND gate 113 which is thus enabled to transmit to the conductor 96' (and hence to the evaluating unit 82 of FIG. 7) density signals at the frequency of timing pulses I' which are transmitted thereto by the conductor 96''. The memory 112 ceases to transmit a signal to the AND gate 113 when its resetting input b receives a signal from the comparator 108, i.e., when the intensity of the density signal D has dropped below the value $D_s$ as a result of advancement of the trailing end of a batch 49 beyond the monitoring device 73.

It will be seen that the switching unit 83'' also enables the evaluating circuit to carry out an evaluation of signals pertaining to the filler 69*f* simultaneously with intermittent evaluation of signals pertaining exclusively or primarily to the batches 49. The manner in which the signals which are transmitted by the AND gate 113 are processed in the evaluating unit 82 is the same as described above in connection with FIG. 7.

In order to suppress the relatively high noise component which is likely to be present in the signals that are transmitted by the assembly 106, i.e., to further reduce the likelihood of distortion of the results of monitoring of the filler 69*f*, the comparators 107 and 108 can receive signals from the analog-digital converter 104 by way of a suitable circuit (not specifically shown) which averages the density signals across the profile of the filler. Such types of averaging circuits are well known in the tobacco processing industry, for example, in connection with the monitoring of densified heads (free ends) of tobacco-containing portions of filter cigarettes.

Referring again to FIG. 2, there is shown a modified density monitoring device for the filler which includes batches 49 of a first type of tobacco and which also contains or is about to contain tobacco particles of a second type. The suction chamber 64 above the lower flight of the conveyor 58 contains a flow restrictor 114 which is disposed in the region of the first filler forming zone 67 and is separated from the remaining part of the suction chamber 64 by a set of throttling elements in the form of thin strips or plates 116 made of sheet metal or the like. A first pressure detector 117 is installed in the flow restrictor 114; this detector forms part of a differential pressure monitoring device 73' which further includes a second detector 117' installed in the suction chamber 64 outside of the flow restrictor 114. The differential pressure monitoring device 73' is connected with an evaluating circuit 119.

FIG. 5 is a plan view of the suction chamber 64 in the region of the flow restrictor 114, with the upper flight of the conveyor 58 and the top wall of the suction chamber removed. The sidewalls 64' of the suction chamber 64 are shown at 64'. The throttling elements 116 are thin strips which extend longitudinally of the suction chamber 64 (i.e., in the direction of movement of the batches 49 at the underside of the lower flight of the conveyor 58) and define between themselves a relatively narrow slit 121 which throttles the flow of air from the flow restrictor 114 to the remaining part of the chamber 64 and into the outlet 66 which is connected to the suction generating device 66'. Since the flow restrictor 114 is disposed at a level above the first filler forming zone 67, where the flow of air through the lower flight of the conveyor 58 and into the suction chamber 64 is unobstructed or is obstructed exclusively by tobacco particles (batches 49) of the first type (i.e., there is nothing to interfere with the flow of air upwardly and through the spaces 49' between successive batches 49), the difference between the pressures which are monitored by the detectors 117 and 117' is indicative of the air-permeability of the conveyor 58 in the zone 67 where the conveyor 58 does not attract any tobacco particles or attracts only tobacco particles (batches 49) of the first type.

If the difference between the pressures which are ascertained by the detectors 117 and 117' is pronounced, this indicates that the permeability of the lower flight of the conveyor 58 and of tobacco thereon to the flow of air is high. When a batch 49 happens to advance below the flow restrictor 114, the difference between the pressures which are ascertained by the detectors 117 and 117' decreases to a certain extent, namely to an extent which is indicative of the density of the batch 49 below the throttling elements 116. If the difference between the signals which are generated by the detectors 117 and 117' equals or approaches zero, this indicates that the combined air permeability of the lower flight of the conveyor 58 and of the batches 49 thereon equals or approaches zero. This, in turn, denotes that the portion of lower flight which advances through the first filler forming zone 67 carries too much tobacco, i.e., the batches 49 are too close to each other. Such situation arises in response to the development of a so-called stopper, namely tobacco piles up at the underside of the lower flight of the conveyor 58 in the second filler forming zone 68 and the pileup propagates itself backwards into the first filler forming zone 67. In other words, the batches 49 which are about to enter the second filler forming zone 68 are pushed rearwardly toward the next-following batches 49 so that the width of the spaces 49' (as considered in the direction of advancement of batches 49 with the lower flight of the conveyor 58) decreases or is even reduced to zero.

The placing of one of the detectors 117, 117' into the portion of the suction chamber 64 where the pressure is increased due to the provision of the flow restrictor 114, and the placing of the other detector into the remaining portion of the suction chamber 64 ensures that the monitoring device 73' can reliably compensate for fluctuations of pressure in the suction chamber 64. Thus, this monitoring device 73' ensures that the results of measurements even more accurately reflect the monitored parameters of the batches or plugs 49.

Figure 11:
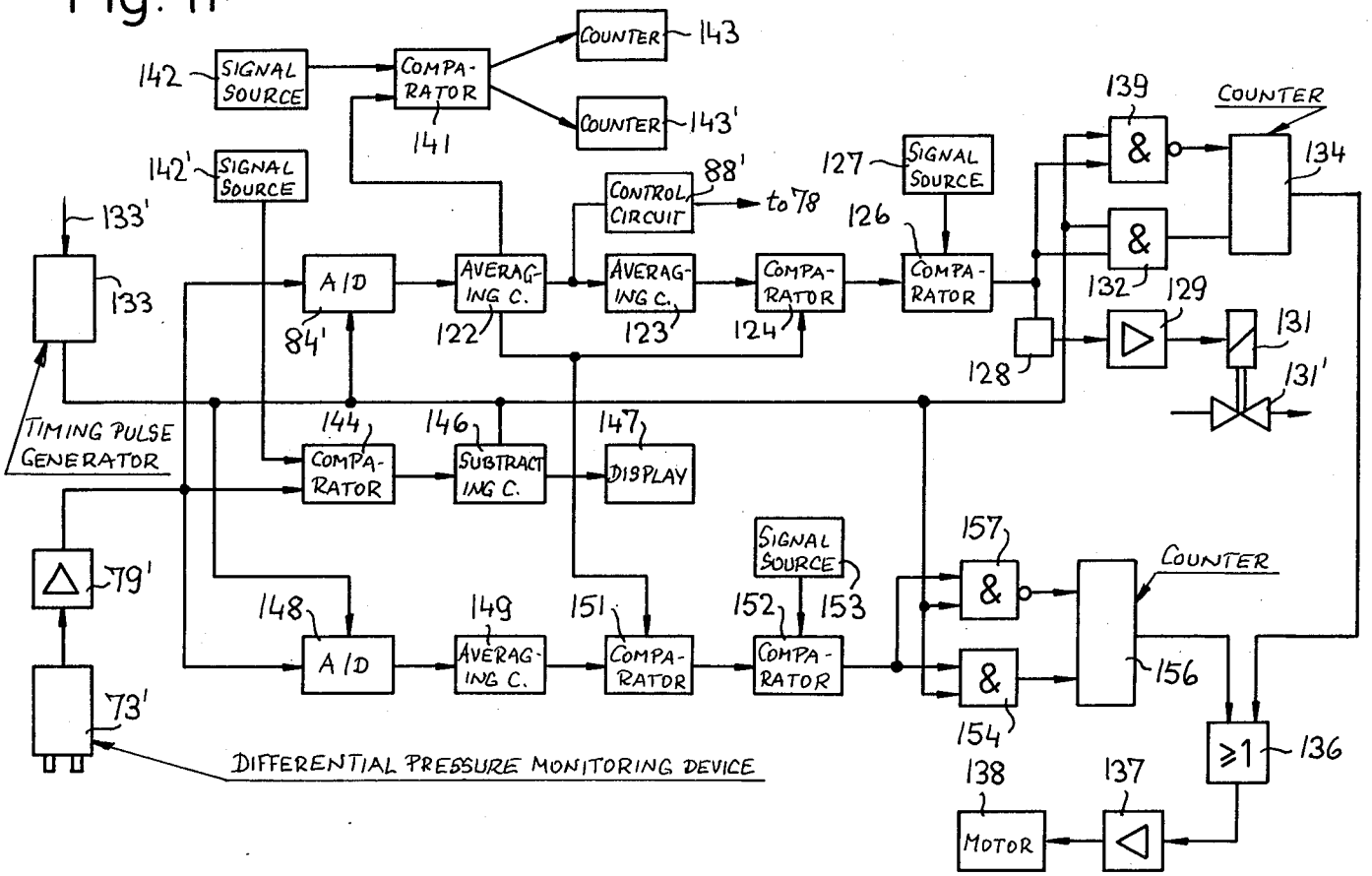
FIG. 11 is a block diagram of a further evaluating circuit and of certain other components of a cigarette rod making machine.

The construction of the evaluating circuit 119 is shown in FIG. 11. The output of the differential pressure monitoring device 73' is connected with an amplifier 79' whose output transmits signals to an analog-digital converter 84'. The output of the converter 84' is connected with a first averaging circuit 122. The averaging circuit 122 can be said to perform the functions of the summing circuit 86 and dividing circuit 87 in the evaluating unit 82 of FIG. 7. The arrangement is such that the circuit 122 averages the signals which are generated by the monitoring device 73' during monitoring of a batch 49.

The output of the averaging circuit 122 is connected with a control circuit 88' which is identical or analogous to the evaluating unit 81 or control circuit 88 of FIG. 7. The output of the control circuit 88' is connected with the servomotor 78 for the regulating valve 257 in the conduit 57' serving to draw air from the suction chamber 57 of the suction wheel 51 at a rate which is determined by momentary setting of the valve 257.

The output of the averaging circuit 122 is further connected with the input of a second averaging circuit 123 which is designed to average a predetermined number of averaged signals transmitted by the circuit 122. Still further, the output of the first averaging circuit 122 is connected with the corresponding input of a comparator 124 which is further connected to the output of the second averaging circuit 123. The comparator 124 generates a signal which is indicative of the difference between the averaged signals from the circuit 122 and the averaged signals from the circuit 123, and its output transmits such difference signals to the corresponding input of a second comparator 126 which is further connected to a preferably adjustable source 127 of reference signals, e.g., a potentiometer. The output of the comparator 126 transmits a defect signal as soon as the difference between the intensities or other characteristics of averaged signals from the circuit 122 and the intensities or other characteristics of averaged signals from the circuit 123 exceeds a preselected value as determined by the setting of the source 127 of reference signals. The output of the comparator 126 transmits the defect signal to a time-delay unit 128 which is connected with the input of an amplifier 129. The output of the amplifier 129 is connected to an actuator 131 (e.g., a relay) for a nozzle 131' which is adjacent to the path of movement of discrete cigarettes of double unit length and serves to segregate each cigarette containing an unsatisfactory batch 49 from the remaining (satisfactory) cigarettes. The time-delay unit 128 ensures that the defect signal which is transmitted by the output of the comparator 126 is advanced to the relay 131 at the same rate at which the corresponding batch 49 (which has caused the generation of a defect signal) advances from the monitoring station (73') to the ejecting or segregating station (nozzle 131').

The defect signal which appears at the output of the comparator 126 is further transmitted to one input of an AND gate 132 the other input of which is connected with the output of a timing pulse generator 133. The latter can include the timing disc 91*a* of FIG. 10. The arrow 133' is intended to denote the means which synchronizes the angular movements of the timing disc 91*a* in the pulse generator 133 with the operation of the cigarette rod making machine so that the disc preferably completes one revolution during each machine cycle.

The output of the AND gate 132 is connected with one input of a counter 134 which totalizes the defect signals coming from the comparator 126. When the counter 134 receives a predetermined number of defect signals, its output transmits a signal to the corresponding input of an OR gate 136 whose output is connected with an amplifier 137. The output of the amplifier 137 is connected with and its signal can arrest the main prime mover 138 of the cigarette rod making machine. Thus, if the evaluating circuit 119 of FIG. 11 detects the presence of several successive unsatisfactory batches 49, this warrants the conclusion that the operation of the machine (or of that portion of the machine which forms the filler 69*f*) is unsatisfactory and that the operation must be interrupted in order to eliminate the cause of defective batches.

The output of the comparator 126 is further connected with one input of an AND gate 139 another input of which is connected with the output of the timing pulse generator 133. The AND gate 139 has an inverting output which is connected to the resetting input of the counter 134 so that the latter is reset to zero as soon as it receives a signal from the output of the AND gate 139.

The AND gate 139 performs the following functions: If the counter 134 is set to transmit a signal to the OR gate 136 in response to reception of say five consecutive defect signals from the AND gate 132, and if the AND gate 132 has already transmitted a series of four consecutive defect signals, the counter 134 is automatically reset to zero if the next-following (fifth) signal is not a defect signal and even if the (sixth) signal which is generated thereafter is again a defect signal. Thus, if the fifth signal is indicative of a satisfactory batch 49, the lower input of the AND gate 139 does not receive a signal from the output of the comparator 126 so that its inverting output transmits a signal to the counter 134 which is reset to zero, i.e., the four stored defect signals are erased and the counter 134 must receive a series of five consecutive defect signals before it can cause the OR gate 136 and amplifier 137 to arrest the prime mover 138. The absence of a single defect signal during advancement of any five consecutive batches 49 past the differential density monitoring device 73' suffices to prevent the counter 134 from initiating a stoppage of the prime mover 138 for the cigarette rod making machine. Such mode of operation reduces the likelihood of too frequent stoppages of the machine with attendant high losses in output.

The output of the first averaging circuit 122 is further connected with one input of a comparator 141 another input of which is connected with an adjustable source 142 of reference signals. The comparator 141 compares each averaged signal (denoting the average density of a batch 49) with the reference signal from the source 142 and its output transmits signals to two counters 143 (for satisfactory batches 49) and 143 (for defective batches 49). Thus, the apparatus is capable of continuously indicating the ratio of satisfactory and unsatisfactory batches per unit of time, per shift or during another selected period of time.

The output of the amplifier 79' is further connected with one input of a comparator 144 which ascertains the exact instant when the intensity or another characteristic of the signal from the monitoring device 73' exceeds or drops below a threshold value selected by a source 142' which is connected to the other input of the comparator 144. At the same time, the comparator 144 compares the instants when the intensity of signals from the monitoring device 73' exceeds or drops below the threshold value (as determined by the source 142') with predetermined (satisfactory or acceptable) instants. If the timing of instants when the threshold value is exceeded or not reached matches the optimum or acceptable timing, this indicates that the length of the respective batches 49 is satisfactory as well as that the positions of successive batches relative to each other are satisfactory (i.e., that the width of the spaces 49', as considered in the direction of travel of batches 49 along the underside of the lower flight of the conveyor 58, is not excessive and is not less than acceptable). If the deviations which are detected by the comparator 144 are excessive, a subtracting circuit 146 (which is connected to the output of the comparator 144) transmits a corresponding signal to a display unit 147 which displays the extent of discrepancy. This enables an attendant to undertake the necessary corrective measures, e.g., by reducing the pressure in the suction chamber 64 so as to further reduce the likelihood of slippage of the conveyor 58 relative to the batches 49 and/or vice versa. It will be noted that the parts 142', 144, 146 and 147 allow for immediate and highly accurate visualization of unsatisfactory length and/or mutual positions of the batches 67 in the first filler forming zone 67.

The evaluating circuit 119 of FIG. 11 comprises an analog-digital converter 148 one input of which is connected with the output of the amplifier 79' and another input of which is connected with the output of the timing pulse generator 133. The output of the analog-digital converter 148 is connected with the input of a third averaging circuit 149. The latter is designed to average the signals denoting the air-permeability of the lower flight of the conveyor 58 in the spaces or gaps 49' between neighboring batches 49. The output of the third averaging circuit 149 is connected with one input of a comparator 151 another input of which is connected with the output of the first averaging circuit 122. The difference signal which is transmitted by the comparator 151 is applied to the corresponding input of a further comparator 152 which is also connected to the output of a source 153 of reference signals. The output of the comparator 152 is connected with one input of an AND gate 154 the other input of which is connected with the timing pulse generator 133. The output of the AND gate 154 is connected to the corresponding input of a counter 156 whose output is connected with the main prime mover 138 of the machine by way of the OR gate 136 and amplifier 137. The signals at the output of the comparator 152 are defect signals, and the output of the counter 156 transmits to the OR gate 136 a signal only when its input receives a preselected number of defect signals from the comparator 152 via AND gate 154. The resetting input of the counter 156 is connected with the inverting output of an AND gate 157 whose purpose is analogous to that of the AND gate 139 and whose inputs are respectively connected with the output of the comparator 152 and timing pulse generator 133. Thus, the counter 156 is reset to zero whenever the AND gate 157 fails to receive a defect signal from the comparator 152 because the inverting output of the AND gate 157 then transmits a signal to the resetting input of the counter 156. The signal which is transmitted by the output of the comparator 151 is indicative of the difference between the permeabilities of the lower flight of the conveyor 58 in the regions of the batches 49 and in the regions of the spaces 49'. If the just mentioned difference approaches or decreases to zero, this indicates the presence of excessive quantities of tobacco particles between neighboring batches 49. This again indicates the presence, or the likelihood of the presence, of a stopper (pileup or jamming) in the second filler forming zone 68, i.e., tobacco piles up in the zone 68 and the pileup propagates itself rearwardly from the duct 70 toward the suction wheel 51. If the number of unsatisfactory spaces 49' reaches a value which is selected by the setting of the counter 156, the latter transmits a signal to the OR gate 136 and such signal is used to stop the main prime mover 138 of the cigarette rod making machine.

The signals which are transmitted by the counter 134 and/or 156 can also be used for other purposes, i.e., not necessarily or exclusively to stop the main prime mover 138. For example, such signals can be used to regulate the rate of delivery of tobacco of the second type via duct 70. Furthermore, the signal which is transmitted to the display unit 147 can also be used to carry out certain adjustments, e.g., to alter the speed ratio of the suction wheel 51 relative to the conveyor 58 in order to eliminate inaccuracies in the positions of successive batches 49 relative to each other.

The evaluating circuit 119 of FIG. 11 can replace the switching unit 83, 83' or 83'' and the evaluating unit 82. Thus, the structure which is shown in FIG. 2 can further comprise a monitoring device 73 which is arranged to monitor the density of the filler downstream of the duct 70 and which transmits signals to an evaluating unit which is identical with or analogous to the evaluating unit 81 of FIG. 7. Since the results of measurement with the device 73' are highly accurate (insofar as the density of the batches 49 is concerned), an apparatus which embodies the monitoring devices 73 and 73' is capable of ensuring an even more reliable regulation of at least one parameter of the filler as well as of one or more parameters of the batches 49. The reason that the results of measurements with the monitoring device 73' very accurately reflect the density of the batches 49 is that, in the region of the detectors 17, 117', the permeability of the lower flight of the conveyor 58 is very pronounced adjacent to the spaces 49' and substantially less pronounced adjacent to the batches 49 so that the contrast between the signals which are generated by the device 73' during monitoring of those portions of the conveyor 58 which carry the batches 49 and the remaining portions of the conveyor 58 (adjacent to the spaces 49') is very pronounced. This further allows for highly accurate determination of the length of each batch and/or of the length of each space 49' between neighboring batches.

An advantage of the averaging circuits 122, 123 and comparators 124 and 126 is that they enable the evaluating circuit 119 to detect the presence of defective batches 49 with a surprisingly high degree of accuracy and reliability so that it can segregate (at 131') all such rod-shaped articles which contain defective batches, i.e., which contain batches whose density deviates from an acceptable density by a value that exceeds the permissible range of tolerances. The comparators 124 and 126 can accurately estimate the quantity of fibers which form the batches 49.

Another advantage of the evaluating circuit 119 is that it allows for a comparison of the signals at the outputs of the averaging circuits 122 and 149 (in the comparator 151). If the difference between the average values which are denoted by the circuits 122 and 149 drops below the value which is determined by the setting of the source 153 of reference signals, this indicates that the pressure differential between those portions of the conveyor 58 which carry the batches 49 and those portions of the conveyor 58 which are not covered by tobacco (spaces 49' ahead of the zone 68) is insufficient, and the comparator 152 then transmits a defect signal which, when the need arises, leads to stoppage of the machine or to the initiation of corrective measures even before the prime mover 138 is arrested.

FIG. 2 further shows a second flow restrictor 158 which is provided in the suction chamber 64 in the region of the second transfer station 59. The flow restrictor 158 includes throttling elements 159 which are or can be identical with the strip-shaped elongated throttling elements 116 of FIG. 5. The purpose of the flow restrictor 158 is to facilitate and render more reliable and predictable the transfer of successive batches 49 from the oncoming pockets 48 of the suction wheel 51 to the underside of the lower flight of the conveyor 58. Thus, the flow restrictor 158 reduces suction in the region of the transfer station 59 (in the space immediately above the lower flight of the conveyor 58). Quite surprisingly, such reduction of suction at the transfer station 59 promotes orderly transfer of the batches 49 from the suction wheel 51 onto the conveyor 58, especially if the suction ports 56 which communicate with the pocket 48 arriving at the transfer station 59 are sealed from the suction chamber 57 (by the stationary valving element 351 in the interior of the rotor of the suction wheel 51 shows in FIG. 2). The establishment of a connection between the channel 61 and the atmosphere or between this channel and a source of slightly compressed air also contributes to more predictable transfer of batches 49 onto the conveyor 58. The suction chamber 64 enables the lower flight of the conveyor 58 to attract a batch 49 with a full force as soon as such batch advances beyond the flow restrictor 158.

FIG. 2 shows that the first flow restrictor 114 is installed in the suction chamber 64 in a region which is adjacent to the first filler forming zone 67. This is preferred for several reasons, especially because the spaces 49' in the zone 67 are (or should be) devoid of tobacco particles so that the detectors 117, 117' of the monitoring device 73' can detect more pronounced differences between the pressure prevailing in the flow restrictor 114 and the pressure prevailing in the remaining portion of the suction chamber 64. However, it is equally within the purview of the invention to install the flow restrictor 114 and the differential pressure monitoring device 73' in the upstream portion of the second filler forming zone 68, i.e., in that part of the zone 68 where the spaces 49' are partially filled with tobacco particles of the second type which are delivered by the duct 70. This is due to the fact that, in the upstream portion of the second filler forming zone 68, the difference between the extent to which the permeability of the lower flight of the conveyor 58 is influenced by the batches 49 (and possibly by tobacco particles of the second type which already adhere to the undersides of the batches 49) and to which the permeability of the lower flight of the conveyor 58 is influenced by tobacco particles of the second type in the spaces 49' is still quite pronounced so that it suffices for satisfactory determination of the positions and/or length and/or density of the batches 49. The duct 70 confines and guides a shower of ascending tobacco particles of the second type in a manner which is known from many types of conventional cigarette rod making machines.

An advantage of the placing of flow restrictor 114 and monitoring device 73' into the upstream portion of the second filler forming zone 68 is that filler stoppers can be detected practically immediately after they begin to develop, i.e., it is not necessary that the pileup of tobacco propagate itself from the zone 68 into the zone 67 in order to be detected by the monitoring device 73' and the associated evaluating circuit 119. As mentioned above, a stopper is likely to have developed when the difference between the pressures which are ascertained by the detectors 117, 117' of the monitoring device 73' equals or approaches zero, i.e., when the pressure in the flow restrictor 114 matches or approximates the pressure in the remaining portion of the suction chamber 64. At such time, the comparator 151 also transmits a defect signal which leads to stoppage of the prime mover 138 and/or to initiation of necessary corrective measures.

Each of the switching units 83' and 83'' which are respectively shown in FIGS. 9 and 10 comprises two components, namely a pulse generating component 90 (including the aforediscussed timing discs 91 and **91*a*) and a selector circuit 89 (FIG. 9) or 89' (FIG. 10) which is actually a gate circuit. The function of the selector circuit 89 or 89' is to transmit incremental timing pulses I or I' to the conductor 96' for the second evaluating unit 82 only when the output of the amplifier 79 transmits signals pertaining to the batches 49. The timing disc 91' of FIG. 7 is designed in such a way that it obviates the need for the selector circuit 89 or 89'**.

It is further clear that the illustrated evaluating circuits are susceptible of many additional modifications without departing from the spirit of the invention. For example, the dividing circuit 87 for the control circuit 88 (both shown in FIG. 7) can be connected with the second averaging circuit 123 of FIG. 11 and hence with the elements which follow the circuit 123.

All embodiments of the improved method and apparatus exhibit the advantage that the parameters of the finished filler **69*f* as well as the parameters of the batches 49 can be monitored at the rate at which the filler is formed. Furthermore, the corrective measures (when necessary) can be undertaken separately, i.e., the results of the monitoring operation or operations can be utilized to influence one or more parameters of the finished filler independently of one or more parameters of the batches 49 and vice versa. Furthermore, the circuitry which is needed to achieve such results is relatively simple and reliable. This holds true irrespective of whether the evaluating circuit 76 employs the switching unit 83, 83' or 83'' and irrespective of whether the monitoring means employs a single monitoring device (73) or two discrete monitoring devices (73, 73'**). The number of monitoring devices depends on the desired accuracy of monitoring of the batches.

Furthermore, the improved method and apparatus exhibit the advantage that the results of measurements and the evaluation of such results can be utilized in a number of different ways, i.e., to influence one or more parameters of the filler independently of one or more parameters of the batches and vice versa, to arrest the main prime mover, to separately count the number of satisfactory and defective batches, to automatically segregate rod-shaped articles which contain defective batches, to display the deviations of the length and/or mutual spacing of batches from optimum length and/or mutual spacing, and/or to automatically correct one or more defects or malfunctions which, heretofore, invariably necessitated a prolonged stoppage of the machine. Still further, the improved method and apparatus render it possible to rapidly detect the presence of stoppers and/or to undertake corrective measures without arresting the prime mover. The apparatus is simple and compact and enables the machine to turn out large numbers of rod-shaped articles per unit of time.

A further important advantage of the improved method and apparatus is that the results of the monitoring operation or operations are highly reliable and accurate irrespective of relative densities of the batches 49 and filler portions 49A. Thus, the monitoring operation is satisfactory even if the density of the batches 49 is the same as that of the filler portions **49*a*. The monitoring device 73 can also be used in an apparatus which embodies the evaluating circuit 76, i.e., in an apparatus wherein the monitoring device 73 transmits signals for evaluation by the units 81 and 82 of the evaluating circuit. The monitoring device 73' then performs the function of ascertaining the presence of batches 49 at a desired mutual spacing from one another. In the absence of such monitoring device, the device 73 would not detect the absence of a batch in the finished filler 69*f* if the space that was supposed to be occupied by a batch is filled with tobacco of the second type (from the duct 70**) and such tobacco exhibits the required density.

The provision of averaging circuits ensures that the detection of discrete unsatisfactory batches does not lead to full stoppage of the machine and attendant losses in output. Also, this ensures that the operation of the machine is smooth, i.e., without frequent interruptions.

The density monitoring device 73 may be a device known as "SRM" which is produced by the assignee of the present application. It is also possible to use a density monitoring device which operates with X-rays, for example, a device known as "ISODEBYEFLEX 2002" which is manufactured by Rich. Seifert & Co., Ahrensburg, German Federal Republic. The differential pressure monitoring device 73' may be of the type known as LX 1601 D which is produced by National Semiconductor.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of producing a continuous rod-like filler of fibrous material, especially a tobacco filler, comprising the steps of accumulating fibrous material of a first type into a row of spaced apart batches and conveying the row along a predetermined path; delivering fibrous material of a second type onto and/or into the spaces between the batches of the row so that the two types of fibrous material together form a rod-like filler; generating first signals which are indicative of at least one parameter of the batches in said path; converting the first signals into first control signals; utilizing the first control signals to influence at least one parameter of the batches; monitoring at least one parameter of the filler; generating second signals which are indicative of such parameter of the filler; converting the second signals into second control signals; and utilizing the second control signals to influence at least one parameter of the filler.

2. The method of claim 1, wherein the step of monitoring at least one parameter of the filler includes continuously monitoring the density of the filler, said step of generating first signals including processing those portions of the second signals which are generated during monitoring of batch-containing filler portions, said converting steps including evaluating the first and second signals independently of one another.

3. The method of claim 2, wherein said step of utilizing the first control signals includes influencing the density of the batches and said step of utilizing the second control signals includes influencing the density of the filler.

4. The apparatus of claim 3, further comprising flow restrictor means provided in a predetermined portion of said suction chamber adjacent to the first portion of said path and arranged to reduce the suction in said predetermined portion, said pneumatic monitoring device including a first detector arranged to monitor the pressure in said predetermined portion of said suction chamber and a second detector arranged to monitor the pressure in the remaining portion of said chamber.

5. The apparatus of claim 3, further comprising flow restrictor means provided in a predetermined portion of said suction chamber adjacent to that portion of the second portion of said path which is close to the first portion of said path and arranged to reduce the suction in said predetermined portion, said pneumatic monitoring device including a first detector arranged to monitor the pressure in said predetermined portion of said suction chamber and a second detector arranged to monitor the pressure in the remaining portion of said chamber.

6. The method of claim 1, further comprising the steps of draping the filler in said path into a web of wrapping material and cyclically subdividing the wrapped filler into articles of finite length at a predetermined frequency so that each article contains at least one batch and at least one portion of fibrous material of the second type, said step of generating first signals including generating a sequence of incremental timing pulses at least during that portion of each cycle when the generation of second signals involves monitoring a batch-containing portion of the filler and utilizing the incremental timing pulses for selective conversion of simultaneously generated second signals into said first control signals.

7. The method of claim 1, wherein said second signals denote the density of the respective portions of the filler, said step of generating first signals including separately processing those density signals which are generated during monitoring of batches in the filler.

8. The method of claim 1, wherein said delivering step includes admitting into said path fibrous material of the second type at a rate exceeding the required quantity of such material in the filler, and further comprising the step of removing the excess from the filler in said path, said step of utilizing the second control signals including regulating the rate of removal of excess from the filler.

9. The method of claim 8, wherein the step of utilizing the first control signals includes influencing the density of said batches.

10. The method of claim 1, wherein said monitoring step includes passing radiation across the path of the filler and monitoring the intensity of radiation which penetrates through successive increments of the filler, such intensity being indicative of the density of the respective increments of the filler.

11. The method of claim 1, wherein said conveying step includes transporting the batches on a foraminous conveyor and said monitoring step includes ascertaining the combined permeability of the conveyor and fibrous material thereon in a predetermined portion of said path.

12. The method of claim 1, wherein said conveying step includes advancing the batches in a predetermined direction along said path and said delivering step includes admitting into a first portion of said path fibrous material of the second type in quantities exceeding those required in the filler, said monitoring step including directing radiation across said path in a second portion of said path downstream of the first portion so that the radiation penetrates through successive increments of the filler and the extent of penetration of such radiation through the filler is indicative of the density of the respective increments thereof and monitoring the intensity of radiation which has penetrated through the filler, said step of utilizing the second control signals including removing the excess of fibrous material from the filler in a third portion of said path between said first and second portions at a rate which is a function of variations of monitored density of the filler, said step of generating first signals including monitoring the permeability of successive increments of the filler and said step of converting the first signals including generating first control signals which are indicative of the density of said batches, said step of utilizing the first control signals including influencing the formation of said batches.

13. The method of claim 1, further comprising the steps of draping the filler in said path into a web of wrapping material and cyclically subdividing the wrapped filler into a series of articles of finite length at a predetermined frequency so that each article contains at least one batch and at least one portion of fibrous material of said second type, said step of generating first signals including generating a sequence of incremental timing pulses at least during that portion of each cycle when the generation of second signals involves monitoring of a batch-containing portion of the filler and utilizing the incremental timing pulses for selective conversion of simultaneously generated second signals into said first control signals each of which is indicative of the density of the respective batch, and further comprising the step of monitoring the dimensions and positions of the batches in said path relative to each other and segregating from said series of articles those articles which contain improperly dimensioned and/or positioned batches.

14. The method of claim 13, wherein said step of monitoring the dimensions and positions of batches includes monitoring the timing of the start and termination of generation of those second signals which are indicative of the density of batches.

15. The method of claim 1, further comprising the step of evaluating said first signals including classifying such first signals according to the integrity or lack of integrity of the respective batches.

16. The method of claim 15, further comprising the step of separately counting the signals which are indicative of acceptable and unsatisfactory batches.

17. In a machine for the making of rod-shaped smokers' articles, apparatus for producing a continuous rod-like filler of fibrous material, particularly a tobacco filler, comprising means for accumulating fibrous material of a first type into a row of spaced apart batches; means for conveying the row of batches in a predetermined direction and along a predetermined path; means for delivering fibrous material of a second type onto and/or into the spaces between the batches in said path so that the two types of fibrous material together form a rod-like filler; means for generating first signals which are indicative of at least one parameter of the batches in said path; a first unit for converting said first signals into first control signals; means for influencing at least one parameter of the batches as a function of said first control signal; means for monitoring at least one parameter of the filler in said path and for generating second signals which are indicative of such parameter of the filler; a second unit for converting said second signals into second control signals; and means for influencing at least one parameter of the filler as a function of said second control signals.

18. The apparatus of claim 17, further comprising signal evaluating means including said first and second units and a switching unit connecting said monitoring means with said first unit and including means for effecting the transmission to said first unit of those second signals which are generated during monitoring of the batch-containing portions of the filler so that the thus transmitted second signals constitute said first signals.

19. The apparatus of claim 18, wherein at least one of said accumulating and delivering means includes means for supplying fibrous material in excess of that which is required in the filler, and further comprising adjustable trimming means for removing the excess from the filler, said means for influencing at least one parameter of the filler including means for adjusting said trimming means.

20. The apparatus of claim 19, wherein said monitoring means includes means for measuring the density of the filler.

21. The apparatus of claim 19, wherein said accumulating means is adjustable and said means for influencing at least one parameter of the batches includes means for adjusting said accumulating means.

22. The apparatus of claim 21, wherein said accumulating means includes a conveyor having batch-receiving portions, means for supplying fibrous material of the first type to said batch-receiving portions, and adjustable means for attracting fibrous material to said batch-receiving portions with a variable force, said adjusting means including means for adjusting said attracting means.

23. The apparatus of claim 22, wherein said attracting means comprises a suction chamber and said adjusting means includes means for regulating the suction in said chamber.

24. The apparatus of claim 18, further comprising means for draping the filler into a web of wrapping material and means for cyclically subdividing the draped filler at a predetermined frequency into a series of discrete rod-shaped articles each of which contains at least one batch and at least some fibrous material of the second type, said switching unit including means for generating a sequence of incremental timing pulses during that portion of each cycle when said monitoring means monitors a batch, said first unit including means for converting into first signals those second signals which are generated simultaneously with said timing pulses.

25. The apparatus of claim 18, further comprising means for draping the filler into a web of wrapping material and means for cyclically subdividing the draped filler at a predetermined frequency into a series of discrete rod-shaped articles each of which contains at least one batch and at least some fibrous material of the second type, said switching unit including means for generating indexing pulses at said frequency and means for transmitting to said first unit incremental timing pulses at least during that portion of each cycle when said monitoring means monitors a batch, said first unit including means for converting into first signals those second signals which are generated simultaneously with incremental timing pulses and contemporaneously with the monitoring of batch-containing portions of the filler.

26. The apparatus of claim 25, wherein said means for transmitting incremental timing pulses includes a rotary disc and means for generating said incremental timing pulses during a portion of each revolution of said timing disc.

27. The apparatus of claim 25, wherein said means for transmitting incremental timing pulses includes means for continuously transmitting such timing pulses and selector means for effecting the transmission to said first unit of those second signals which are generated simultaneously with incremental timing pulses while said monitoring means monitors the batch-containing portions of the filler.

28. The apparatus of claim 27, wherein said selector means includes means for effecting the transmission, during each cycle, to the first unit of those second signals which are generated simultaneously with a preselected number of incremental timing pulses, such number being less than the total number of timing pulses per cycle.

29. The apparatus of claim 18, wherein said switching unit comprises at least one threshold comparator having an input connected with said monitoring means and an output, presetting means for selecting the threshold of said comparator so that the latter can effect the transmission of a selected number of said second signals, and means for connecting the output of said comparator with said first unit so that the latter receives second signals until such time when the comparator terminates the transmission of the selected number of second signals.

30. The apparatus of claim 18, wherein said first unit includes means for averaging the second signals which are generated while said monitoring means monitors a batch-containing portion of the filler.

31. The apparatus of claim 18, wherein said monitoring means includes means for directing radiation across said path and means for ascertaining the intensity of radiation which penetrates through successive increments of the filler, such intensity being indicative of the density of the respective increments of the filler.

32. The apparatus of claim 17, wherein said conveying means comprises a foraminous conveyor and said monitoring means comprises means for monitoring the permeability of successive increments of the conveyor and of the fibrous material thereon.

33. The apparatus of claim 17, wherein said conveying means comprises a foraminous conveyor and said monitoring means includes means for directing radiation across said path and means for ascertaining the intensity of radiation which penetrates through successive increments of the filler in said path, such intensity being indicative of the density of the corresponding increments of the filler, said means for generating first signals including means for monitoring the permeability of successive increments of the conveyor and of the fibrous material thereon.

34. The apparatus of claim 17, wherein said conveying means includes a foraminous conveyor having an elongated portion extending along said path and a suction chamber adjacent to one side of said portion of said conveyor, said accumulating means including means for supplying successive batches of said row to the other side of said portion of said conveyor in a first portion of said path and said delivering means comprising means for showering fibrous material of the second type against said other side of said portion of said conveyor in a second portion of said path downstream of said first portion, and further comprising means for reducing the suction in said chamber opposite said first portion of said path.

35. A method of producing a continuous rod-like filler of fibrous material, especially a tobacco filler, comprising the steps of accumulating fibrous material of a first type into a row of spaced apart batches and conveying the row along a predetermined path, said accumulating step including delivering fibrous material of the first type into an endless second path and attracting the thus delivered fibrous material of the first type by suction to selected portions of said second path; delivering fibrous material of a second type onto and/or into the spaces between the batches of the row so that the two types of fibrous material together form a rod-like filler; generating first signals which are indicative of at least one parameter of the batches in said path; converting the first signals into first control signals; and utilizing the first control signals to influence at least one parameter of the batches, including regulating the suction in said selected portions of the second path.

36. In a machine for the making of rod-shaped smokers' articles, apparatus for producing a continuous rod-like filler of fibrous material, particularly a tobacco filler, comprising means for accumulating fibrous material of a first type into a row of spaced apart batches; means for conveying the row of batches in a predetermined direction and along a predetermined path; means for delivering fibrous material of the second type onto and/or into the spaces between the batches in said path so that the two types of fibrous material together form a rod-like filler, said conveying means including an endless foraminous conveyor having a portion extending along said path and a suction chamber adjacent to one side of said portion of said conveyor, said accumulating means being arranged to deliver successive batches of said row to the other side of said portion of said conveyor in a first portion of said path and said delivering means being arranged to admit fibrous material of the second type to the other side of said portion of said conveyor in a second portion of said path downstream of said first portion; means for generating first signals which are indicative of at least one parameter of the batches in said path, including a pneumatic monitoring device adjacent to said first portion of said path and arranged to monitor the density of successive increments of said portion of said conveyor and of the batches thereon; a first unit for converting said first signals into first control signals; means for influencing at least one parameter of the batches as a function of said first control signals; second monitoring means for generating second signals denoting the density of successive increments of the filler downstream of said second portion of said path; a second unit for converting said second signals into second control signals; and means for influencing at least one parameter of the filler as a function of said second signals.

37. In a machine for the making of rod-shaped smokers' articles, apparatus for producing a continuous rod-like filler of fibrous material, particularly a tobacco filler, comprising means for accumulating fibrous material of a first type into a row of spaced apart batches; means for conveying the row of batches in a predetermined direction and along a predetermined path; means for delivering fibrous material of a second type onto and/or the spaces between the batches in said path so that the two types of fibrous material together form a rod-like filler; means for generating first signals which are indicative of at least one parameter of the batches in said path; an evaluating circuit including a first unit for converting said first signals into first control signals and means for monitoring the times of arrival of the leaders of successive batches of said row into a predetermined portion of said path; means for comparing such times with anticipated times; and means for influencing at least one parameter of the batches as a function of said first control signals.

38. In a machine for the making of rod-shaped smokers' articles, apparatus for producing a continuous rod-like filler of fibrous material, particularly a tobacco filler, comprising means for accumulating fibrous material of a first type into a row of spaced apart batches; means for conveying the row of batches in a predetermined direction and along a predetermined path; means for delivering fibrous material of a second type onto and/or into the spaces between the batches in said path so that the two types of fibrous material together form a rod-like filler; means for generating first signals which are indicative of at least one parameter of the batches in said path; a first unit for converting said first signals into first control signals, including first averaging means for generating third signals each of which is indicative of the average value of all first signals pertaining to a batch, second averaging means for generating fourth signals each of which is indicative of the average value of a predetermined number of successively generated third signals, and means for comparing each third signal with one of said fourth signals and for generating said first control signals when the deviation of a third signal from the fourth signal exceeds a preselected value; and means for influencing at least one parameter of the batches as a function of said first control signals.

39. The apparatus of claim 38, further comprising an evaluating circuit including said first unit and further comprising means for monitoring the filler downstream of said accumulating means for the presence and length of spaces between successive batches of said row, means for generating fifth signals denoting the detection of successive increments of such spaces, means for generating sixth signals denoting the average values of those fifth signals which pertain to a particular space, and means for comparing said third signals with said sixth signals and for generating defect signals when the difference between a third and a sixth signal exceeds a predetermined value.

40. The apparatus of claim 38, further comprising means for separately counting third signals which pertain to acceptable batches and third signals which pertain to unsatisfactory batches.

* * * * *

UNITED STATES PATENT AND TRADEMARK OFFICE

CERTIFICATE OF CORRECTION

PATENT NO. : 4,616,662

DATED : October 14, 1986

INVENTOR(S) : Werner HARTMANN et al.

It is certified that error appears in the above-identified patent and that said Letters Patent are hereby corrected as shown below:

FOREMOST PAGE - [75] Inventors: after "Neu Börnsen" --Horst-Dieter Preuss, Glinde,-- should be added.

Col. 21, line 36 - after "chamber" --64-- should be inserted;

line 36 - "64'" should be deleted.

Col. 24, line 17 - "143" should read --143'--.

This certificate supersedes certificate of correction issued May 26, 1987.

Signed and Sealed this

Eighth Day of September, 1987

*Attest:*

DONALD J. QUIGG

*Attesting Officer*

*Commissioner of Patents and Trademarks*